US008348372B2

(12) United States Patent
Chikuma et al.

(10) Patent No.: US 8,348,372 B2
(45) Date of Patent: Jan. 8, 2013

(54) INK JET PRINTING APPARATUS AND INK JET PRINTING METHOD

(75) Inventors: Toshiyuki Chikuma, Tokyo (JP); Hirokazu Yoshikawa, Yokohama (JP); Susumu Hirosawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 306 days.

(21) Appl. No.: 12/638,220

(22) Filed: Dec. 15, 2009

(65) Prior Publication Data

US 2010/0156981 A1 Jun. 24, 2010

(30) Foreign Application Priority Data

Dec. 19, 2008 (JP) ..... 2008-323803

(51) Int. Cl.
*B41J 29/38* (2006.01)

(52) U.S. Cl. ..... 347/14; 347/5

(58) Field of Classification Search ..... 347/14, 347/19

See application file for complete search history.

(56) References Cited

U.S. PATENT DOCUMENTS

| | | | | |
|---|---|---|---|---|
| 5,524,994 | A | 6/1996 | Hirano et al. | 400/579 |
| 5,615,873 | A | 4/1997 | Kobayashi et al. | 271/121 |
| 5,648,807 | A | 7/1997 | Saito et al. | 347/102 |
| 5,742,316 | A | 4/1998 | Hirano et al. | 347/104 |
| 5,850,235 | A | 12/1998 | Saito et al. | 347/22 |
| 5,946,016 | A | 8/1999 | Saito et al. | 347/104 |
| 6,027,204 | A | 2/2000 | Hirano et al. | 347/49 |
| 6,206,500 | B1 | 3/2001 | Hirano et al. | 347/35 |
| 6,623,093 | B2 * | 9/2003 | Takahashi et al. | 347/16 |
| 6,629,743 | B2 | 10/2003 | Chikuma et al. | |
| 6,764,154 | B2 | 7/2004 | Nishikori et al. | |
| 7,296,872 | B2 | 11/2007 | Hayashi et al. | |
| 7,296,877 | B2 | 11/2007 | Chikuma et al. | |
| 7,367,643 | B2 | 5/2008 | Furuichi et al. | |

FOREIGN PATENT DOCUMENTS

| | | |
|---|---|---|
| JP | 06-091861 | 4/1994 |
| JP | 7-205416 A | 8/1995 |
| JP | 2002-200741 | 7/2002 |
| JP | 2002-337319 | 11/2002 |
| JP | 2007-015376 A | 1/2007 |

OTHER PUBLICATIONS

Office Action—Japanese Patent Appln. No. 2009-278753, Japanese Patent Office, Jul. 3, 2012.

* cited by examiner

*Primary Examiner* — Laura Martin
(74) *Attorney, Agent, or Firm* — Fitzpatrick, Cella, Harper & Scinto

(57) ABSTRACT

An ink jet printing apparatus and an ink jet printing method are provided in which information about an ink amount ejected on each of unit areas into which a preceding print medium is divided and information about a size of a following print medium are acquired. A delay time for delaying a printing operation for the following print medium is set based on the information about the ink amount ejected on unit areas which are decided among the divided unit areas according to the information about the size of the following print medium.

14 Claims, 28 Drawing Sheets

INTERVAL TIME T1

| | |
|---|---|
| Dmax≧Dth | 10 |
| Dth>Dmax | 0 |

(SECOND)

Dth : 12800dots

FIG.11

3RD SHEET

2ND SHEET

1ST SHEET

DmaxN FOR PRECEDING PRINTED SHEET (A4 SIZE)

| | LATERAL SIZE≦L | L<LATERAL SIZE≦2L | 2L<LATERAL SIZE | PRINT TIME |
|---|---|---|---|---|
| | DmaxN_L[dots] | DmaxN_2L[dots] | DmaxN_A4[dots] | TsN [sec] |
| AREA0 | 2900 | 2900 | 2900 | 0.5 |
| AREA1 | 3100 | 3100 | 3100 | 1 |
| AREA2 | 8000 | 8000 | 8000 | 1.5 |
| AREA3 | 9200 | 10000 | 10000 | 2 |
| AREA4 | 11000 | 11000 | 11000 | 2.5 |
| AREA5 | 10100 | 10100 | 10100 | 3 |
| AREA6 | 9300 | 9300 | 9300 | 3.5 |
| AREA7 | 9700 | 9700 | 13000 | 4 |
| AREA8 | 9500 | 15000 | 15000 | 4.5 |
| AREA9 | 9600 | 9600 | 9600 | 5 |
| AREA10 | 6780 | 6780 | 6780 | 5.5 |
| AREA11 | 8190 | 8190 | 8190 | 6 |
| AREA12 | 12000 | 12000 | 12000 | 6.5 |
| AREA13 | 4800 | 4800 | 4800 | 7 |
| AREA14 | 8400 | 8400 | 8400 | 7.5 |
| AREA15 | 6600 | 6600 | 6600 | 8 |
| AREA16 | 7500 | 7500 | 7500 | 8.5 |
| AREA17 | 7050 | 9300 | 9300 | 9 |
| AREA18 | 9300 | 9300 | 13000 | 9.5 |
| AREA19 | 8730 | 8730 | 8730 | 10 |
| AREA20 | 4300 | 4300 | 4300 | 10.5 |

FIG.18

EXAMPLE OF DmaxcM FOR CURRENTLY PRINTED SHEET (L SIZE)
(WHEN PRINTING IS FINISHED UP TO AREA 3)

| | LATERAL SIZE≦L | L<LATERAL SIZE≦2L | 2L<LATERAL SIZE | PRINT TIME | ELAPSED TIME |
|---|---|---|---|---|---|
| | DmaxcN_L[dots] | DmaxcN_2L[dots] | DmaxcN_A4[dots] | Tsc[sec] | Tsc-TsN |
| AREA0 | 2900 | 2900 | 2900 | 10.8 | 0.3 |
| AREA1 | 3100 | 3100 | 3100 | 11.1 | 1.1 |
| AREA2 | 8000 | 8000 | 8000 | 11.4 | 1.9 |
| AREA3 | 9200 | 9200 | 9200 | 11.7 | 2.7 |
| AREA4 | | | | | |
| AREA5 | | | | | |
| AREA6 | | | | | |
| AREA7 | | | | | |
| AREA8 | | | | | |
| AREA9 | | | | | |
| AREA10 | | | | | |
| AREA11 | | | | | |
| AREA12 | | | | | |
| AREA13 | | | | | |
| AREA14 | | | | | |
| AREA15 | | | | | |
| AREA16 | | | | | |
| AREA17 | | | | | |
| AREA18 | | | | | |
| AREA19 | | | | | |
| AREA20 | | | | | |

FIG.19

EXAMPLE OF DmaxcM FOR CURRENTLY PRINTED SHEET (L SIZE)
(WHEN PRINTING IS FINISHED UP TO FINAL AREA 8)

| | LATERAL SIZE≦L | L<LATERAL SIZE≦2L | 2L<LATERAL SIZE | PRINT TIME | ELAPSED TIME |
|---|---|---|---|---|---|
| | DmaxcN_L[dots] | DmaxcN_2L[dots] | DmaxcN_A4[dots] | Tsc[sec] | Tsc-TsN |
| AREA0 | 2900 | 2900 | 2900 | 10.8 | 0.3 |
| AREA1 | 3100 | 3100 | 3100 | 11.1 | 1.1 |
| AREA2 | 8000 | 8000 | 8000 | 11.4 | 1.9 |
| AREA3 | 9200 | 9200 | 9200 | 11.7 | 2.7 |
| AREA4 | 10000 | 10000 | 10000 | 12 | 3.5 |
| AREA5 | 8540 | 8540 | 8540 | 12.3 | 4.3 |
| AREA6 | 9470 | 9470 | 9470 | 12.6 | 5.1 |
| AREA7 | 3600 | 3600 | 3600 | 12.9 | 5.9 |
| AREA8 | 2040 | 2040 | 2040 | 13.2 | 6.7 |
| AREA9 | | | | | |
| AREA10 | | | | | |
| AREA11 | | | | | |
| AREA12 | | | | | |
| AREA13 | | | | | |
| AREA14 | | | | | |
| AREA15 | | | | | |
| AREA16 | | | | | |
| AREA17 | | | | | |
| AREA18 | | | | | |
| AREA19 | | | | | |
| AREA20 | | | | | |

FIG.20

| | $D_0$ | | $D_1$ | | $D_2$ | | $D_3$ | | $D_4$ | | $D_5$ | | $D_6$ | | ..... | $D_{max-6}$ | | $D_{max-5}$ | | $D_{max-4}$ | | $D_{max-3}$ | | $D_{max-2}$ | | $D_{max-1}$ | | $D_{max}$ | |
|---|---|---|---|---|---|---|---|---|---|---|---|---|---|---|---|---|---|---|---|---|---|---|---|---|---|---|---|---|---|
| | $D_{max}$ | Ts | $D_{max}$ | Ts | $D_{max}$ | Ts | $D_{max}$ | Ts | $D_{max}$ | Ts | $D_{max}$ | Ts | $D_{max}$ | Ts | ..... | $D_{max}$ | Ts | $D_{max}$ | Ts | $D_{max}$ | Ts | $D_{max}$ | Ts | $D_{max}$ | Ts | $D_{max}$ | Ts | $D_{max}$ | Ts |
| AREA0 | | | | | | | | | | | | | | | | | | | | | | | | | | | | | |
| AREA1 | | | | | | | | | | | | | | | | | | | | | | | | | | | | | |
| AREA2 | | | | | | | | | | | | | | | | | | | | | | | | | | | | | |
| AREA3 | | | | | | | | | | | | | | | | | | | | | | | | | | | | | |
| AREA4 | | | | | | | | | | | | | | | | | | | | | | | | | | | | | |
| AREA5 | | | | | | | | | | | | | | | | | | | | | | | | | | | | | |
| AREA6 | | | | | | | | | | | | | | | | | | | | | | | | | | | | | |
| AREA7 | | | | | | | | | | | | | | | | | | | | | | | | | | | | | |
| AREA8 | | | | | | | | | | | | | | | | | | | | | | | | | | | | | |
| AREA9 | | | | | | | | | | | | | | | | | | | | | | | | | | | | | |
| AREA10 | | | | | | | | | | | | | | | ..... | | | | | | | | | | | | | | |
| AREA11 | | | | | | | | | | | | | | | | | | | | | | | | | | | | | |
| AREA12 | | | | | | | | | | | | | | | | | | | | | | | | | | | | | |
| AREA13 | | | | | | | | | | | | | | | | | | | | | | | | | | | | | |
| AREA14 | | | | | | | | | | | | | | | | | | | | | | | | | | | | | |
| AREA15 | | | | | | | | | | | | | | | | | | | | | | | | | | | | | |
| AREA16 | | | | | | | | | | | | | | | | | | | | | | | | | | | | | |
| AREA17 | | | | | | | | | | | | | | | | | | | | | | | | | | | | | |
| AREA18 | | | | | | | | | | | | | | | | | | | | | | | | | | | | | |
| AREA19 | | | | | | | | | | | | | | | | | | | | | | | | | | | | | |
| AREA20 | | | | | | | | | | | | | | | | | | | | | | | | | | | | | |

DmaxN REFERENCING RANGE WHEN PAPER IS FED FROM FIRST PAPER SUPPLY PORT

DmaxN REFERENCING RANGE WHEN PAPER IS FED FROM SECOND PAPER SUPPLY PORT

FIG.21

FIG.22

DmaxN AFTER BEING FROM DmaxcM OF SECOND SHEET

| | LATERAL SIZE≦L | L<LATERAL SIZE≦2L | 2L<LATERAL SIZE | PRINT TIME |
|---|---|---|---|---|
| | DmaxN_L[dots] | DmaxN_2L[dots] | DmaxN_A4[dots] | TsN[sec] |
| AREA0 | 0 | 0 | 0 | 10.8 |
| AREA1 | 0 | 0 | 0 | 10.8 |
| AREA2 | 0 | 0 | 0 | 10.8 |
| AREA3 | 0 | 0 | 0 | 10.8 |
| AREA4 | 0 | 0 | 0 | 10.8 |
| AREA5 | 0 | 0 | 0 | 10.8 |
| AREA6 | 0 | 0 | 0 | 10.8 |
| AREA7 | 0 | 0 | 0 | 10.8 |
| AREA8 | 0 | 0 | 0 | 10.8 |
| AREA9 | 0 | 0 | 0 | 10.8 |
| AREA10 | 0 | 0 | 0 | 10.8 |
| AREA11 | 0 | 0 | 0 | 10.8 |
| AREA12 | 2900 | 2900 | 2900 | 10.8 |
| AREA13 | 3100 | 3100 | 3100 | 11.1 |
| AREA14 | 8000 | 8000 | 8000 | 11.4 |
| AREA15 | 9200 | 9200 | 9200 | 11.7 |
| AREA16 | 10000 | 10000 | 10000 | 12 |
| AREA17 | 8540 | 8540 | 8540 | 12.3 |
| AREA18 | 9470 | 9470 | 9470 | 12.6 |
| AREA19 | 3600 | 3600 | 3600 | 12.9 |
| AREA20 | 2040 | 2040 | 2040 | 13.2 |

DmaxcM FOR THIRD SHEET (A4 SIZE)

| | LATERAL SIZE≦L | L<LATERAL SIZE≦2L | 2L<LATERAL SIZE | PRINT TIME | ELAPSED TIME FROM SECOND SHEET | ELAPSED TIME FROM FIRST SHEET |
|---|---|---|---|---|---|---|
| | DmaxcN_L[dots] | DmaxcN_2L[dots] | DmaxcN_A4[dots] | TsN[sec] | Tsc-TsN | Tsc-TsN |
| AREA0 | 2900 | 2900 | 2900 | 13.7 | 0.5 | 3.2 |
| AREA1 | 3100 | 3100 | 3100 | 14.2 | 1.1 | 4.2 |
| AREA2 | 8000 | 8000 | 8000 | 14.7 | 1.9 | 5.2 |
| AREA3 | 9200 | 10000 | 10000 | 15.2 | 2.7 | 6.2 |
| AREA4 | 11000 | 11000 | 11000 | 15.7 | 3.7 | 7.2 |
| AREA5 | 10100 | 10100 | 10100 | 16.2 | 4.7 | 8.2 |
| AREA6 | 9300 | 9300 | 9300 | 16.7 | 5.7 | 9.2 |
| AREA7 | 9700 | 9700 | 13000 | 17.2 | 6.7 | 10.2 |
| AREA8 | 9500 | 15000 | 15000 | 17.7 | 7.7 | 11.2 |
| AREA9 | 9600 | 9600 | 9600 | 18.2 | 7.7 | 12.2 |
| AREA10 | 6780 | 6780 | 6780 | 18.7 | 7.7 | 13.2 |
| AREA11 | 9190 | 8190 | 8190 | 19.2 | 7.7 | 14.2 |
| AREA12 | 12000 | 12000 | 12000 | 19.7 | 7.7 | 15.2 |
| AREA13 | 4800 | 4800 | 4800 | 20.2 | 7.7 | 16.2 |
| AREA14 | 8400 | 8400 | 8400 | 20.7 | 7.7 | 17.2 |
| AREA15 | 6600 | 6600 | 6600 | 21.2 | 7.7 | 18.2 |
| AREA16 | 7500 | 7500 | 7500 | 21.7 | 7.7 | 19.2 |
| AREA17 | 7050 | 9300 | 9300 | 22.2 | 7.7 | 20.2 |
| AREA18 | 9300 | 9300 | 13000 | 22.7 | 7.7 | 21.2 |
| AREA19 | 8730 | 8730 | 8730 | 23.2 | 7.7 | 22.2 |
| AREA20 | 4300 | 4300 | 4300 | 23.7 | 7.7 | 23.2 |

FIG.23

TABLE RELATING DmaxN TO TsN IN SECOND EMBODIMENT

| | AREA $D_0$ TO $D_L$ | | AREA $D_{L+1}$ TO $D_{2L}$ | | AREA $D_{2L+1}$ TO $D_{A4}$ | |
|---|---|---|---|---|---|---|
| | DmaxN_0L [dots] | TsN_0-L [sec] | DmaxN_L-2L [dots] | TsN_L-2L [sec] | DmaxN_2L-A4 [dots] | TsN_2L-A4 [sec] |
| AREA0 | 2900 | 0.5 | 2900 | 0.5 | 2900 | 0.5 |
| AREA1 | 3100 | 1 | 3100 | 1 | 3100 | 1 |
| AREA2 | 8000 | 1.5 | 8000 | 1.5 | 8000 | 1.5 |
| AREA3 | 9200 | 2 | 10000 | 2 | 7000 | 2 |
| AREA4 | 11000 | 2.5 | 9000 | 2.5 | 11000 | 2.5 |
| AREA5 | 10100 | 3 | 101000 | 3 | 0 | 3 |
| AREA6 | 9300 | 3.5 | 9300 | 3.5 | 0 | 3.5 |
| AREA7 | 9700 | 4 | 9700 | 4 | 13000 | 4 |
| AREA8 | 9500 | 4.5 | 15000 | 4.5 | 15000 | 4.5 |
| AREA9 | 9600 | 5 | 9600 | 5 | 9600 | 5 |
| AREA10 | 6780 | 5.5 | 6780 | 5.5 | 6780 | 5.5 |
| AREA11 | 8190 | 6 | 8190 | 6 | 8190 | 6 |
| AREA12 | 2900 | 10.8 | 12000 | 6.5 | 12000 | 6.5 |
| AREA13 | 3100 | 11.1 | 4800 | 7 | 4800 | 7 |
| AREA14 | 8000 | 11.4 | 8400 | 7.5 | 8400 | 7.5 |
| AREA15 | 9200 | 11.7 | 6600 | 8 | 6600 | 8 |
| AREA16 | 10000 | 12 | 7500 | 8.5 | 7500 | 8.5 |
| AREA17 | 8540 | 12.3 | 9300 | 9 | 9300 | 9 |
| AREA18 | 9470 | 12.6 | 9300 | 9.5 | 13000 | 9.5 |
| AREA19 | 3600 | 12.9 | 8730 | 10 | 8730 | 10 |
| AREA20 | 2040 | 13.2 | 4300 | 10.5 | 4300 | 10.5 |

FIG.24

INTERVAL TIME T1

| | MAXIMUM DOT COUNT VALUE Dmax | FAST←DRIVER UI QUALITY→FINE | | | | | WAITING TIME FOR INK TO DRY |
|---|---|---|---|---|---|---|---|
| | | 5 | 4 | 3 | 2 | 1 | |
| level 1 | Dmax≧Dth_2 | 0 | 0 | 0 | 0 | 0 | SHORT |
| | Dth_2>Dmax≧Dth_1 | 0 | 0 | 0 | 0 | 0 | ↑ |
| | Dth_1>Dmax | 0 | 0 | 0 | 0 | 0 | |
| level 2 | Dmax≧Dth_2 | 0 | 0 | 0 | 0 | 0 | |
| | Dth_2>Dmax≧Dth_1 | 0 | 0 | 0 | 0 | 0 | |
| | Dth_1>Dmax | 0 | 0 | 0 | 0 | 0 | |
| level 3 | Dmax≧Dth_2 | 0 | 0 | 5 | 5 | 15 | |
| | Dth_2>Dmax≧Dth_1 | 0 | 0 | 0 | 0 | 0 | |
| | Dth_1>Dmax | 0 | 0 | 0 | 0 | 0 | |
| level 4 | Dmax≧Dth_2 | 10 | 10 | 15 | 15 | 25 | |
| | Dth_2>Dmax≧Dth_1 | 5 | 5 | 10 | 10 | 20 | |
| | Dth_1>Dmax | 0 | 0 | 0 | 0 | 0 | |
| level 5 | Dmax≧Dth_2 | 15 | 15 | 20 | 20 | 30 | |
| | Dth_2>Dmax≧Dth_1 | 10 | 10 | 15 | 15 | 25 | LONG |
| | Dth_1>Dmax | 0 | 0 | 0 | 0 | 0 | |

FIG.27

INK JET PRINTING APPARATUS AND INK JET PRINTING METHOD

BACKGROUND OF THE INVENTION

1. Field of the Invention

The present invention relates to an ink jet printing apparatus and an ink jet printing method which successively stack a plurality of print mediums printed with an image one upon the other.

2. Description of the Related Art

An printing apparatus has an improved printing speed in recent years, with the printing time required to print on a print medium such as paper and a supply time and a discharge time between a print medium and the next (paper supply/discharge time) decreasing year by year. So a possibility is growing that, before a printed and discharged medium has its image dried enough, the next printed medium may be discharged and stacked on the first one. In that case, upon contact of the surface of the first printed medium and the back of the next printed medium, the printed image of the first medium may be disturbed and the back of the second medium smeared. Since ink on the printed surface of the first medium is not sufficiently dry, the back of the second medium may stick to the first because of the viscous ink.

Japanese Patent Laid-Open No. H06-091861 (1994) discloses a construction in which, when a next printed medium (also referred to as a "subsequent print medium") is discharged onto a first printed medium (also referred to as a "preceding print medium"), the subsequent print medium is deflected. That is, by deflecting the subsequent print medium, the time at which the print medium comes into contact with the preceding print medium is delayed. Japanese Patent Laid-Open No. 2002-200741 describes a method of controlling the timing of printing on the subsequent print medium according to a parameter related to the ink drying time in the preceding print medium.

The print timing control method such as described in Japanese Patent Laid-Open No. 2002-200741 does not require a special construction of Japanese Patent Laid-Open No. H06-091861 (1994). However, the print timing control method assumes that print mediums of the same size are printed successively with images and discharged and stacked at the same position.

Therefore, when a plurality of print mediums of different sizes are successively printed with images, or when a plurality of print mediums of the same size, after being printed, are discharged and stacked shifted in a widthwise direction of the print medium, there is a possibility of the print timing being delayed more than necessary. That is, in the former case, because of the size difference between the preceding print medium and the subsequent print medium, there is a portion in these print mediums where they do not overlap when discharged. In the latter case, since the preceding print medium and the subsequent print medium are shifted in the widthwise direction when stacked one upon the other, these print mediums have a portion where they do not overlap. So, controlling print timing of the subsequent print medium without considering the portion where the preceding and subsequent print mediums do not overlap may result in the print timing being delayed more than necessary.

SUMMARY OF THE INVENTION

The present invention provides a printing apparatus and a printing method that perform a print operation according to a state of overlapping of successively printed mediums in order to prevent printed images from being disturbed or the print mediums being smeared, without slowing down the print speed more than necessary.

In the first aspect of the present invention, there is provided an ink jet printing apparatus which prints on a print medium by scanning of a print head in a scanning direction and transporting the print medium in a transporting direction, the ink jet printing apparatus comprising: a first acquiring unit that acquires information about an ink amount ejected on each of unit areas into which a preceding print medium is divided in the scanning direction and the transporting direction; a second acquiring unit that acquires information about a size of a following print medium; and a setting unit that sets a delay time for delaying a printing operation for the following print medium based on information about an ink amount ejected on unit areas which are decided among the divided unit areas according to the information about the size of the following print medium.

In the second aspect of the present invention, there is provided an ink jet printing apparatus which prints on a print medium by scanning of a print head in a scanning direction and transporting the print medium in a transporting direction, the ink jet printing apparatus comprising: a first acquiring unit that acquires information about an ink amount ejected on each of unit areas into which a preceding print medium is divided in the scanning direction and the transporting direction; a plurality of supply units capable of supplying the print mediums with reference to different reference positions in the scanning direction; a setting unit that sets a delay time for delaying a printing operation for the following print medium based on information about an ink amount ejected on unit areas which are decided among the divided unit areas according to the supply unit used for supplying the print medium.

In the third aspect of the present invention, there is provided an ink jet printing method for printing on a print medium by scanning of a print head in a scanning direction and transporting the print medium in a transporting direction, the ink jet printing apparatus comprising steps of: acquiring information about an ink amount ejected on each of unit areas into which a preceding print medium is divided in the scanning direction and the transporting direction; acquiring information about a size of a following print medium; and setting a delay time for delaying a printing operation for the following print medium based on information about an ink amount ejected on unit areas which are decided among the divided unit areas according to the information about the size of the following print medium.

In the fourth aspect of the present invention, there is provided an ink jet printing method for printing on a print medium by scanning of a print head in a scanning direction and transporting the print medium in a transporting direction, the ink jet printing apparatus comprising steps of: acquiring information about an ink amount ejected on each of unit areas into which a preceding print medium is divided in the scanning direction and the transporting direction; supplying the print medium by using a plurality of supply units capable of feeding the print mediums with reference to different reference positions in the scanning direction; setting a delay time for delaying a printing operation for the following print medium based on information about an ink amount ejected on unit areas which are decided among the divided unit areas according to the supply unit used for feeding the print medium.

According the present invention, while keeping a slowdown of printing speed to a minimum, a plurality of print mediums printed with images can be prevented from being smeared as they are successively stacked one upon the other.

Further features of the present invention will become apparent from the following description of exemplary embodiments (with reference to the attached drawings).

BRIEF DESCRIPTION OF THE DRAWINGS

FIG. 11 is an explanatory diagram showing intervals between printing operations of FIG. 10;

FIG. 18 shows an example of information on an A4-size sheet used in the print operation of FIG. 16;

FIG. 19 shows an example of information on an L-size sheet being printed in the print operation of FIG. 16;

FIG. 20 shows an example of information on an L-size sheet upon completion of printing in the print operation of FIG. 16;

FIG. 21 shows a relation between a print sheet and the maximum number of dots when a sheet of the same size as the preceding one is discharged laterally shifted in the print operation of FIG. 16;

FIG. 22 is an explanatory diagram of information on printed sheets that has been updated using information on a second sheet of L size in the print operation of FIG. 16;

FIG. 23 is an explanatory diagram of information that is stored when a third sheet of A4 size is printed in the print operation of FIG. 16;

FIG. 24 is a table showing a relation between the maximum number of dots and a print execution time in a second embodiment of this invention;

FIG. 27 is a table of thresholds for the number of dots used in the process of FIG. 26.

DESCRIPTION OF THE EMBODIMENTS

By referring to the accompanying drawings, embodiments of the present invention will be described in detail.

First Embodiment

A printing apparatus that can apply the present invention will be explained in the following separate configurations: "Basic Configuration", "System Configuration" and "Head Construction".

"Basic Configuration"

Figure 1:
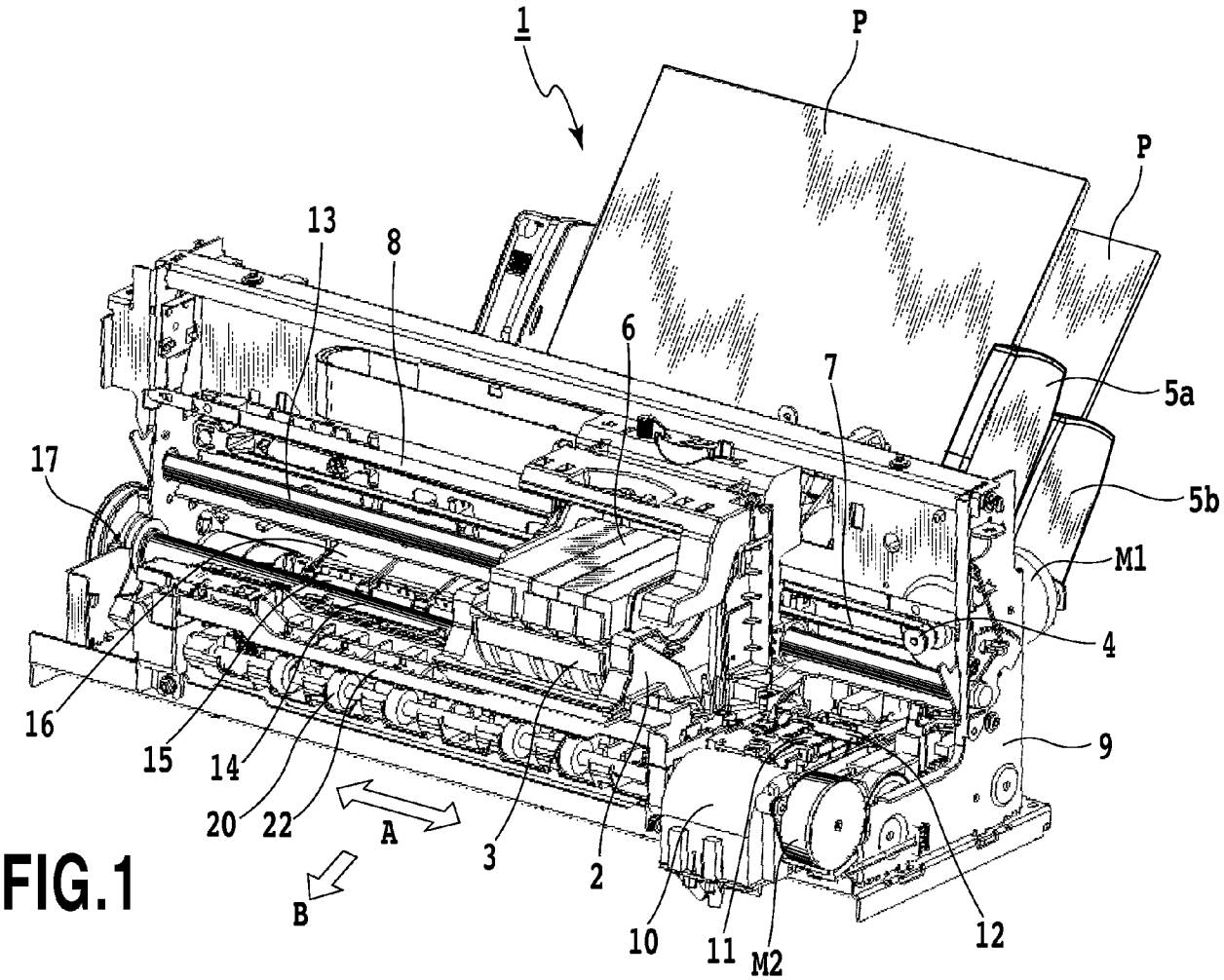
FIG. 1 is an external perspective view showing essential portions of an ink jet printing apparatus that can apply the present invention.

FIG. 1 is a perspective view showing essential portions of an ink jet printing apparatus as one embodiment capable of applying the present invention.

This example is a serial scan type ink jet printing apparatus 1, with an ink ejection print head 3 removably mounted on a carriage 2. The carriage 2 is reciprocally moved in a main scan direction (scanning direction) indicated with an arrow A by a drive force of a carriage motor M1 transmitted through a transmission mechanism 4. A print medium P such as a sheet of paper is fed to a print position by a paper feed unit 5*a* or 5*b*. Two different operations—an operation of ejecting ink from the print head 3 onto the print medium P at the print position as the print head 3 is moved in the main scan direction and an operation of transporting the print medium P in a subscan direction (transporting direction) indicated with an arrow B—are alternated repetitively to print an image progressively on the print medium P. The subscan direction crosses the main scan direction (at right angles in this example).

The carriage 2 has removably mounted thereon, along with the print head 3, an ink cartridge 6 holding ink to be supplied to the print head 3.

The printing apparatus 1 of this example is able to print a color image, with the carriage 2 mounting four ink cartridges 6 of cyan (C), magenta (M), yellow (Y) and black (K) inks. These four ink cartridges 6 can be mounted and removed independently.

The carriage 2 and the print head 3 remain electrically connected with each other by keeping their opposite joint surfaces in correct contact. The print head 3 is applied an energy corresponding to a print signal to selectively eject ink from a plurality of ejection openings for printing. The print head 3 may use electrothermal conversion elements (heaters) and piezoelectric elements as ink ejection energy generation elements. When heaters are used, the electric energy applied to the heaters is transformed into a thermal energy which in turn causes a film boiling in ink. Then, a pressure change produced by the growth and contraction of a bubble in ink causes the ink to be expelled from the ejection opening. The heater is provided so as to correspond to each of the many ejection openings. In response to the print signal, a pulse voltage is applied selectively to a plurality of heaters, causing ink to be ejected from those ejection openings associated with the heaters.

The carriage 2 is connected to a part of a drive belt 7 of the transmission mechanism 4 that transmits the drive force of the carriage motor M1, and is also slidably guided along a guide shaft 13 in the direction of arrow A. So, the carriage 2 is reciprocally moved along the guide shaft 13 in the direction of arrow A as the carriage motor M1 is driven forwardly or reversely. A scale 8 is installed to indicate an absolute position of the carriage 2 in its moving direction (arrow A). In this embodiment a transparent PET film printed with black bars at predetermined intervals is used as the scale 8, with one of its end secured to a chassis 9 and the other supported by a leaf spring (not shown).

In the printing apparatus 1 a platen (not shown) is installed that opposes a nozzle face of the print head 3 formed with the nozzle openings (not shown). While reciprocally moving the carriage 2 carrying the print head 3 by the drive force of the carriage motor M1, a print signal is applied to the print head 3 to cause it to eject ink for printing on the print medium P transported over the platen.

In FIG. 1, reference number 14 represents a transport roller driven by a transport motor M2 to transport the print medium P and reference number 15 represents a pinch roller to engage the print medium P against the transport roller 14 by a spring (not shown). Denoted 16 is a pinch roller holder to rotatably support the pinch roller 15, and 17 a transport roller gear secured to one end of the transport roller 14. The transport roller 14 is rotated by the drive force of the transport motor M2 transmitted to the transport roller gear 17 through an intermediate gear (not shown).

Designated 20 is a discharge roller to discharge the print medium P, printed with an image by the print head 3, out from the printing apparatus. The discharge roller 20 is driven by the transmission of rotation of the transport motor M2, and engages with a spur roller (not shown) that is pressed against the print medium P by a spring (not shown). Denoted 22 is a spur holder 22 to rotatably support the spur roller.

"System Configuration"

Figure 2:
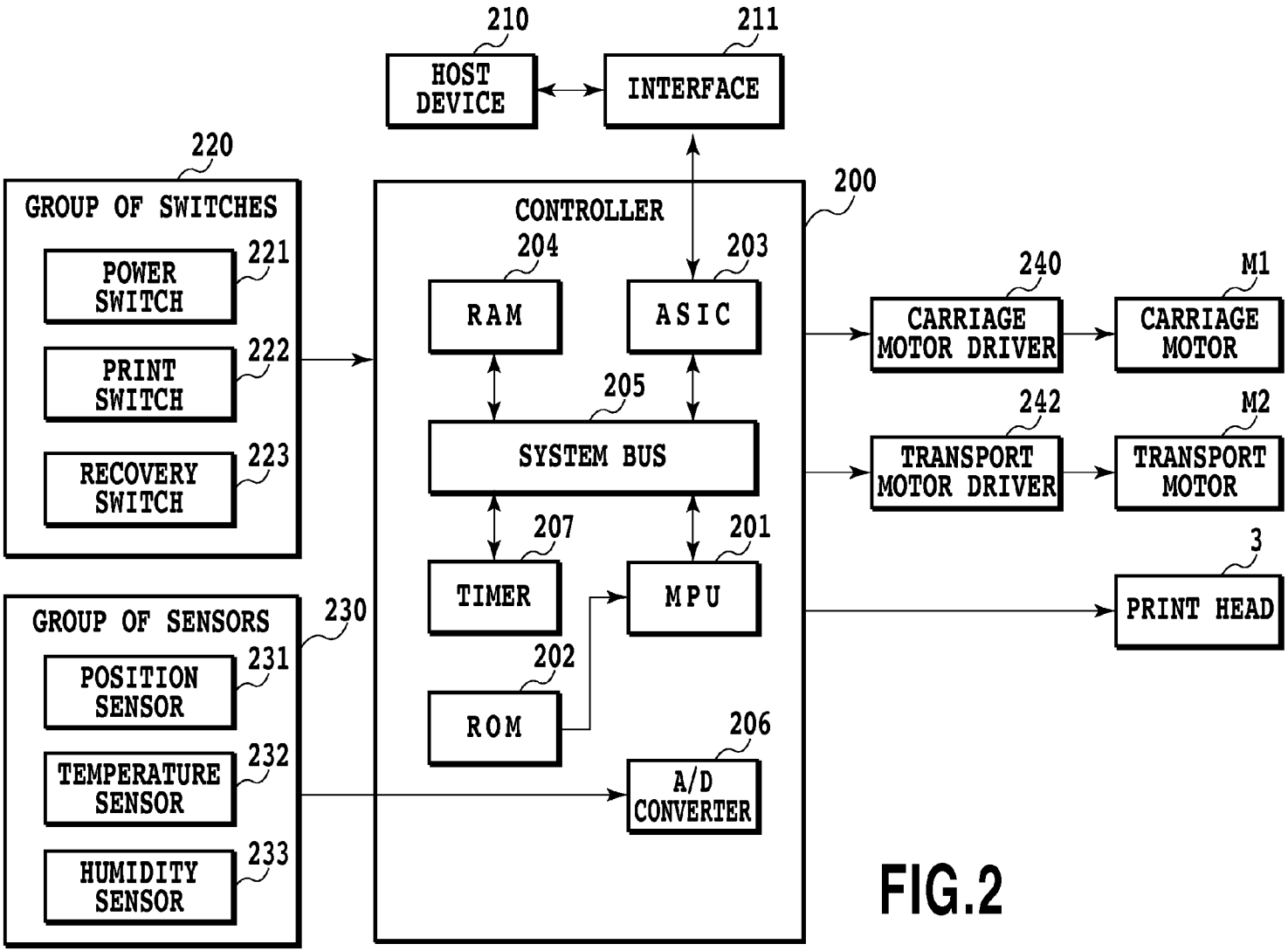
FIG. 2 is a block configuration diagram showing a control system of the printing apparatus of FIG. 1.

FIG. 2 is a block diagram showing a configuration of a control system of the printing apparatus 1.

As shown in FIG. 2, a controller 200 comprises an MPU 201, a ROM 202, an ASIC (Application-Specific Integrated Circuit) 203, a RAM 204, a system bus 205, an A/D converter 206 and a timer 207. The ROM 202 stores programs associated with control sequences to be described later, required tables and other fixed data. The ASIC 203 generates control signals for the control of the carriage motor M1, the transport motor M2 and the print head 3. The RAM 204 is provided with an image data development area and a work area for program executions. The system bus 205 interconnects the MPU 201, ASIC 203 and RAM 204 to transfer data among them. The A/D converter 206 takes in analog signals from a group of sensors described in the following, performs an A/D conversion to convert these analog signals into digital signals and supplies the digital signals to the MPU 201. The timer 207 is used for time management in a control sequence described later.

In FIG. 2, denoted 210 is a computer (or an image reader and a digital camera) that functions as an image data source and is generally called a host device. Between the host device 210 and the printing apparatus 1 are transferred image data, commands and status signals via an interface (I/F) 211.

Denoted 220 is a group of switches that accepts command inputs from an operator, such as a power switch 221, a print switch 222 to start printing and a recovery switch 223. The recovery switch 223 is for starting an operation to maintain the ink ejection performance of the print head 3 in good condition (recovery operation). Denoted 230 is a group of sensors for detecting a state of the printing apparatus, including a position sensor 231, a temperature sensor 232 and a humidity sensor 233. The position sensor 231 may be a photocoupler intended to detect a home position, and the temperature sensor 232 is installed at an appropriate location in the printing apparatus to detect an ambient temperature. The humidity sensor 233 is installed at an appropriate location in the printing apparatus to detect an ambient humidity.

Denoted 240 is a carriage motor driver to drive the carriage motor M1 for reciprocally scanning the carriage 2 in the direction of arrow A. Designated 242 is a transport motor driver to drive the transport motor M2 for transporting a print medium P.

The printing apparatus constructed as described above analyzes commands of print data transferred through the interface 211 and develops the image data for printing in the RAM 204. During the printing scan of the print head 3 the ASIC 203 directly accesses the memory area of the RAM 204 and transfers drive data for ejection energy generation elements (such as heaters) from the RAM to the print head.

"Head Construction"

Figure 3:
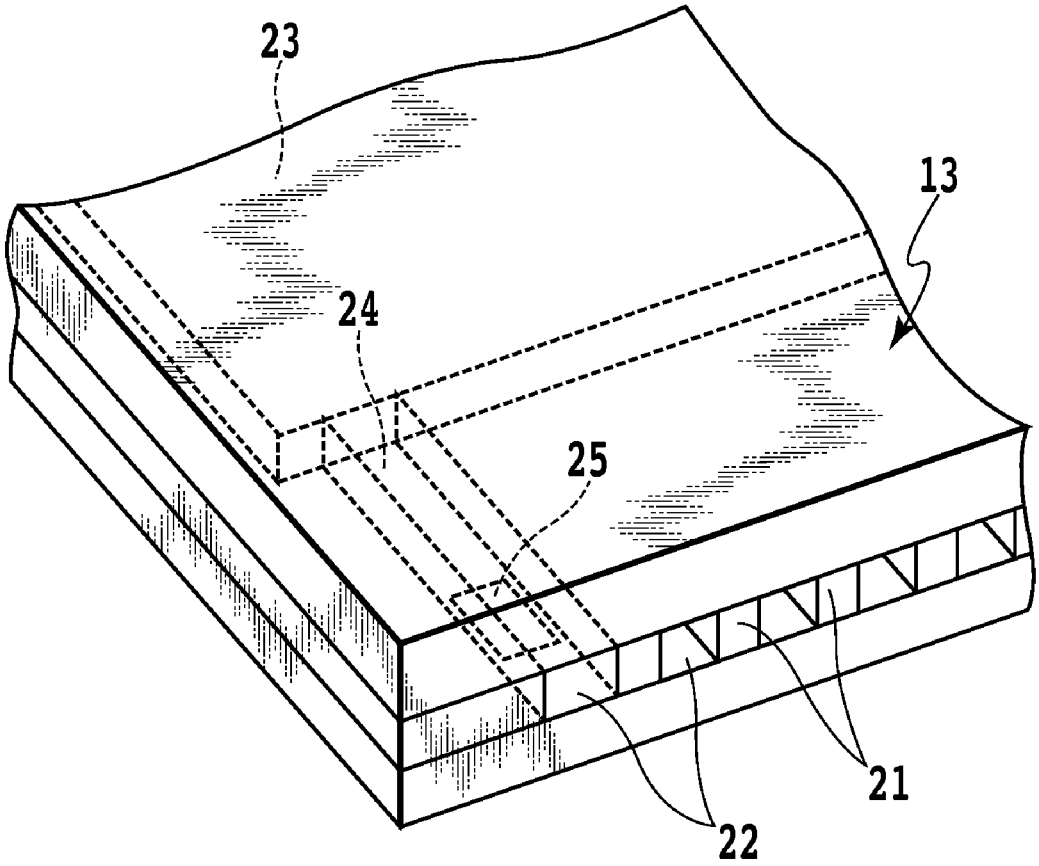
FIG. 3 is an enlarged perspective view showing an essential portion of a print head installed in the printing apparatus of FIG. 1.

FIG. 3 is a schematic perspective view showing a part of an essential construction of the ink ejection unit 13 of the print head 3.

In FIG. 3, a nozzle face 21 of the print head 3 opposing a print medium P with a predetermined gap (about 0.5-2 mm) in between is formed with a plurality of nozzle openings 22 at a predetermined pitch. These nozzle openings 22 communicate with a common liquid chamber 23 through individual flow paths 24, along a wall surface of which the electrothermal conversion elements (e.g., heaters) 25 as the ink ejection energy generation elements are arranged. The print head 3 is mounted on the carriage 2 so that the plurality of nozzle openings 22 are aligned in a direction crossing the scan direction of the carriage 2 (at right angles in this example). The heaters 25 are driven (energized) according to the print signal or ejection signal to generate a film boiling in ink in each of the flow path 24, ejecting ink from the nozzle openings 22 by the pressure of a bubble formed. While this embodiment has used the thermal energy generation heaters as a unit to eject ink, other devices such as piezoelectric elements may also be used.

"Basic Print Operation"

Next, a basic print operation of this embodiment will be explained. Here a print operation involving successively printing on sheets of the same size and discharging the printed sheets at the same position will be explained.

FIG. 4 to FIG. 8 represent the "basic print operation", showing how, immediately after a sheet (print medium) 521 has been printed, the print operation is performed on the next sheet (print medium) 522.

Print sheets 521 and 522 are of the same size and their print areas are vertically divided into a plurality of areas (hereinafter referred to as "horizontal strip areas"), each covering 320 lines/600 dpi. The horizontal strip areas in the printed sheet 521 are referred to, from the downstream side of an arrow in the figures (indicating the direction in which the print medium is discharged) to the upstream side, as area 0

(500_1), area 1 (501_1), area N (5N_1), area 20 (520_1). In the print sheet 522 the divided areas are referred to, from the downstream side of the sheet discharge direction to the upstream side, as area 0 (500_2), area 1 (501_2), area M (5M_2), . . . , area 20 (520_2). In FIG. 4 to FIG. 8 the shaded horizontal strip areas are where the print operation has finished.

Information concerning a printed area N (a horizontal strip area in the printed sheet 521) that is stored in memory includes a print execution time (TsN) representing the time at which the print operation was performed on that area N and the maximum number of dots (DmaxN) as a maximum value among the numbers of dots formed in each of unit areas of that area N. Similarly, information concerning a printed area M (a horizontal strip area in the printed sheet 522) that is stored in memory includes a print execution time (TscM) representing the time at which the print operation was performed on that area M and the maximum number of dots (DmaxcM) as a maximum value among the numbers of dots formed in each of unit areas of that area M. The printed sheet 522 is discharged to be stacked on the printed sheet 521. For the sake of explanation, however, the printed sheets are shown laterally separate in FIG. 4 to FIG. 8.

Figure 4:
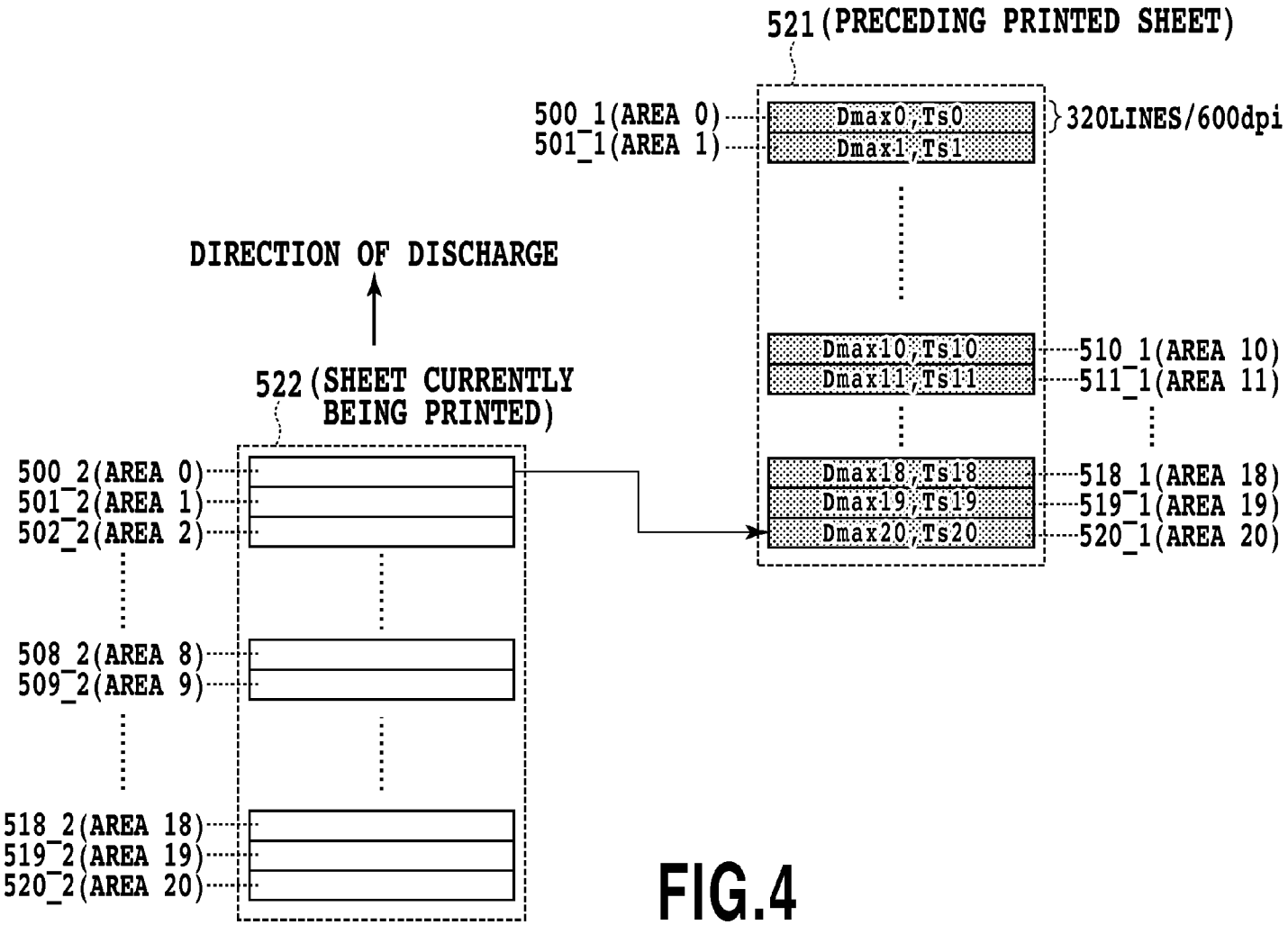
FIG. 4 shows horizontal strip areas of an already printed sheet that is referenced when an area 0 of another sheet is being printed by a basic print operation of this invention.

FIG. 4 shows the sheet 522 being put at its print start position. Since the print operation has not yet started on the sheet 522, all horizontal strip areas are shown not shaded. Before printing the front end area 0 (500_2), the controller references the maximum number of dots (Dmax20) of area 20 (520_1) in the printed sheet 521. The area 20 is an area in the printed sheet 521 with that the sheet 522 comes into contact after the area 0 of sheet 522 is printed. Then, as described later, the print sheet 522 is transported forward at a timing that matches a value of the maximum number of dots of the printed sheet 521 (Dmax20) to put area 0 of the sheet 522 at the print position.

Figure 5:
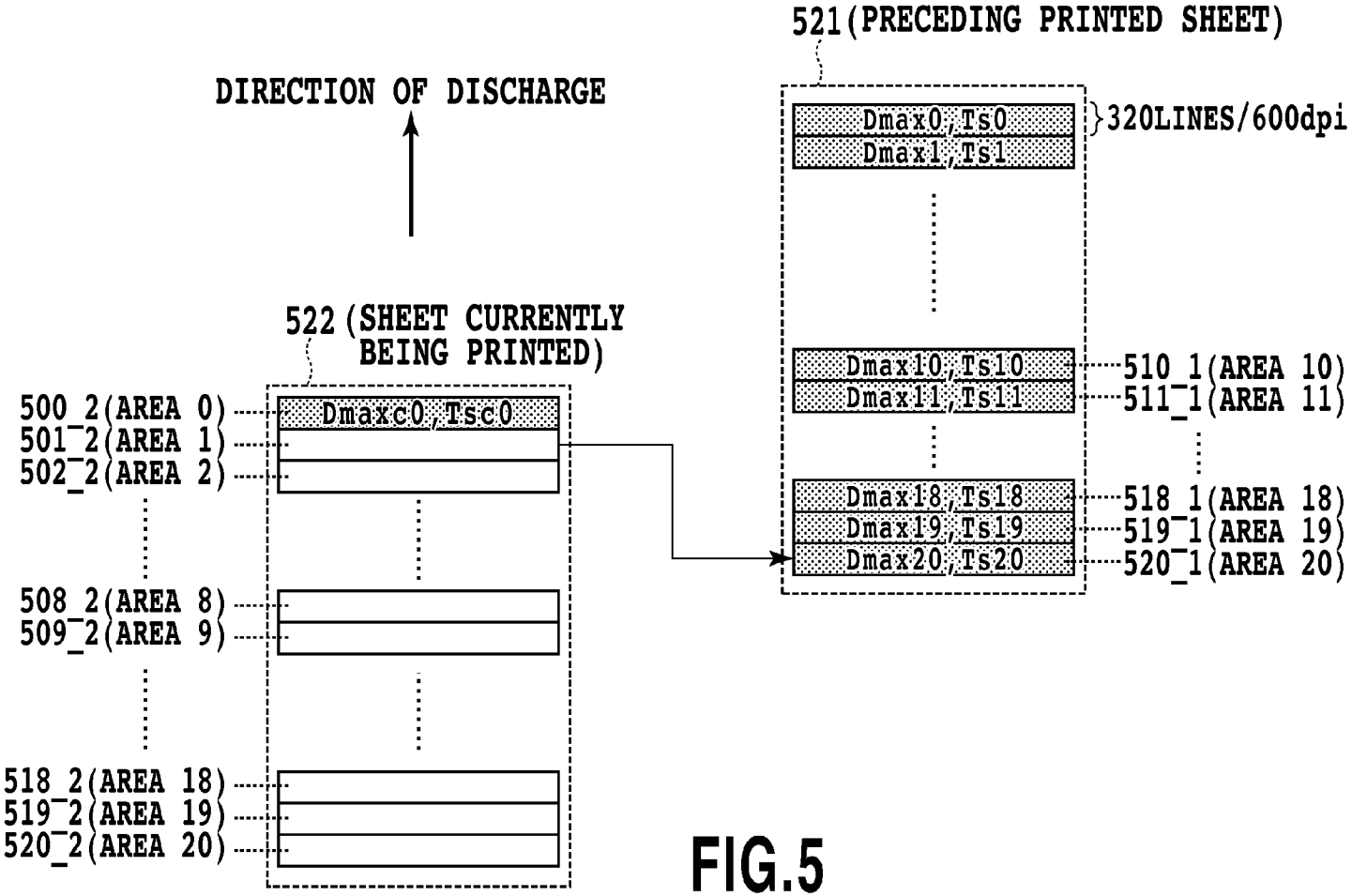
FIG. 5 shows horizontal strip areas of an already printed sheet that is referenced when an area 1 of another sheet is being printed by a basic print operation of this invention.

FIG. 5 shows a state of the sheet 522 after transporting its area 0 to the print position, printing on the area 0 and storing the print execution time (Tsc0) and the maximum number of dots (Dmaxc0) of the area 0. Then, in the same way as described above, before printing the next area 1 (501_2), the controller refers to the maximum number of dots (Dmax19) of area 19 (519_1) in the printed sheet 521. The area 19 is an area in the printed sheet 521 with that the sheet 522 comes into contact after the area 1 of sheet 522 is printed. Then, as described later, the sheet 522 is transformed forward at a timing that matches a value of the maximum number of dots (Dmax19) to put area 1 of the sheet 522 at the print position.

Figure 6:
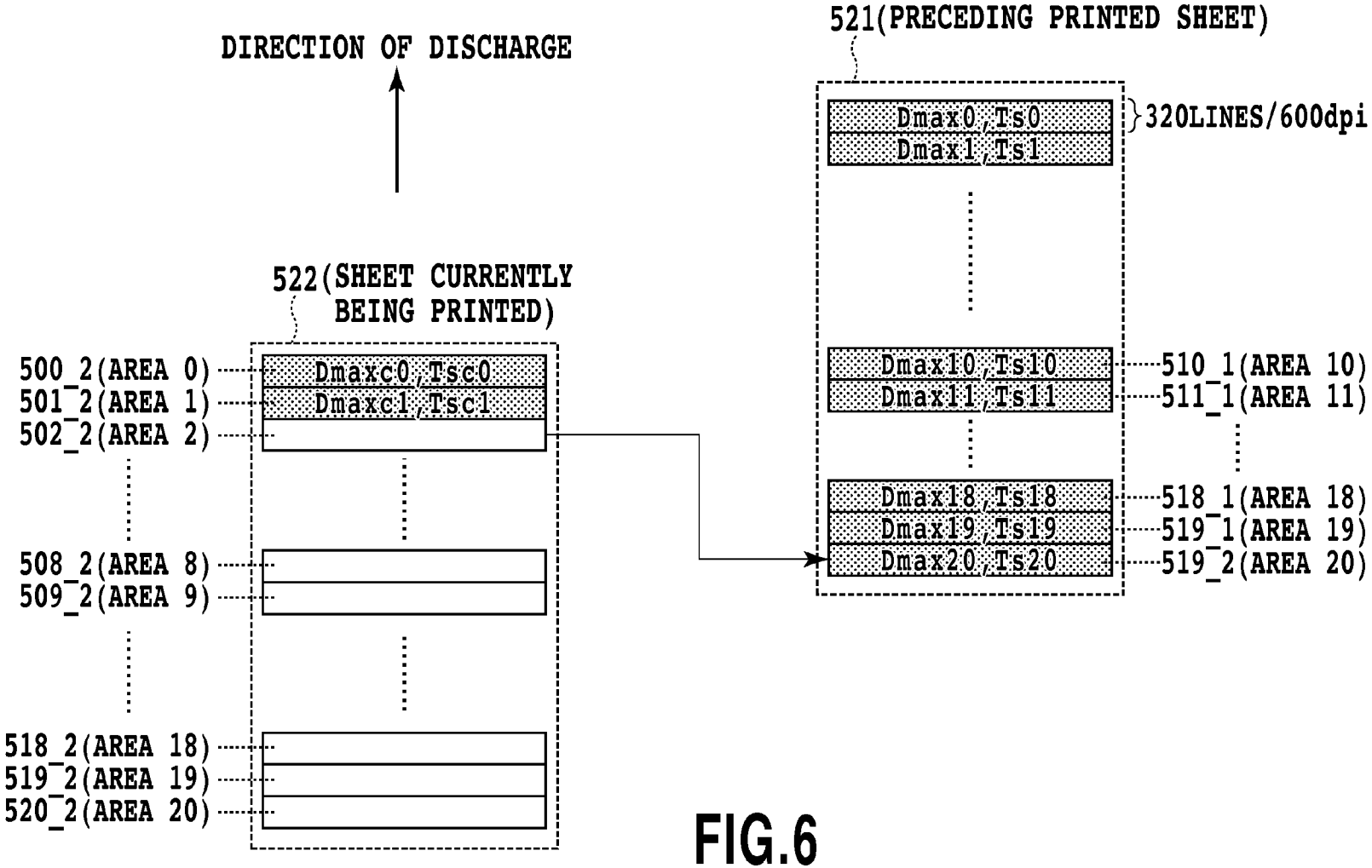
FIG. 6 shows horizontal strip areas of an already printed sheet that is referenced when an area 2 of another sheet is being printed by a basic print operation of this invention.
Figure 7:
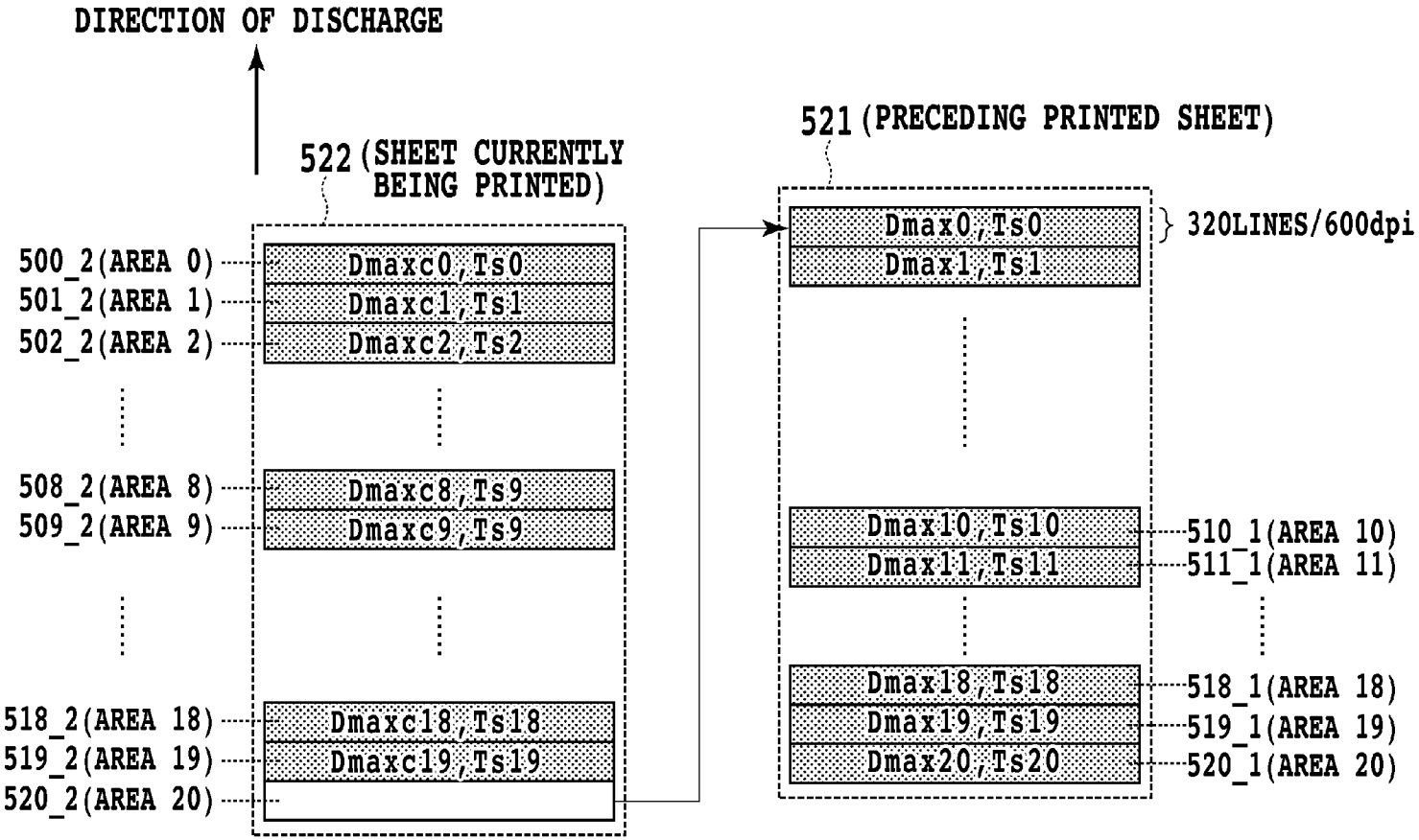
FIG. 7 shows horizontal strip areas of an already printed sheet that is referenced when an area 20 of another sheet is being printed by a basic print operation of this invention.

FIG. 6 shows a state of the sheet 522 after transporting its area 1 to the print position, printing on the area 1 and storing the print execution time (Tsc1) and the maximum number of dots (Dmaxc1) of the area 1. This process is repeated up to the area 20 at the rear end of the sheet 522. FIG. 7 shows a printing state of the sheet 522 before the rear-end area 20 of the sheet 522 is printed. With this area 20 printed, the printing of the sheet 522 is complete.

The positional arrangements of the area M (M=0, 1, 2, . . . , 20) of the sheet 522 and the corresponding area N (N=0, 1, 2, . . . 20) of the printed sheet 521, that is referenced when printing the area M, are opposite, as can be seen from FIGS. 4 to 7 and FIG. 8. That is, the reference number of the area M in the sheet 522 to be printed changes in an ascending order while that of the area N in the sheet 521, which is referenced before printing the area M, changes in a descending order.

Figure 9:
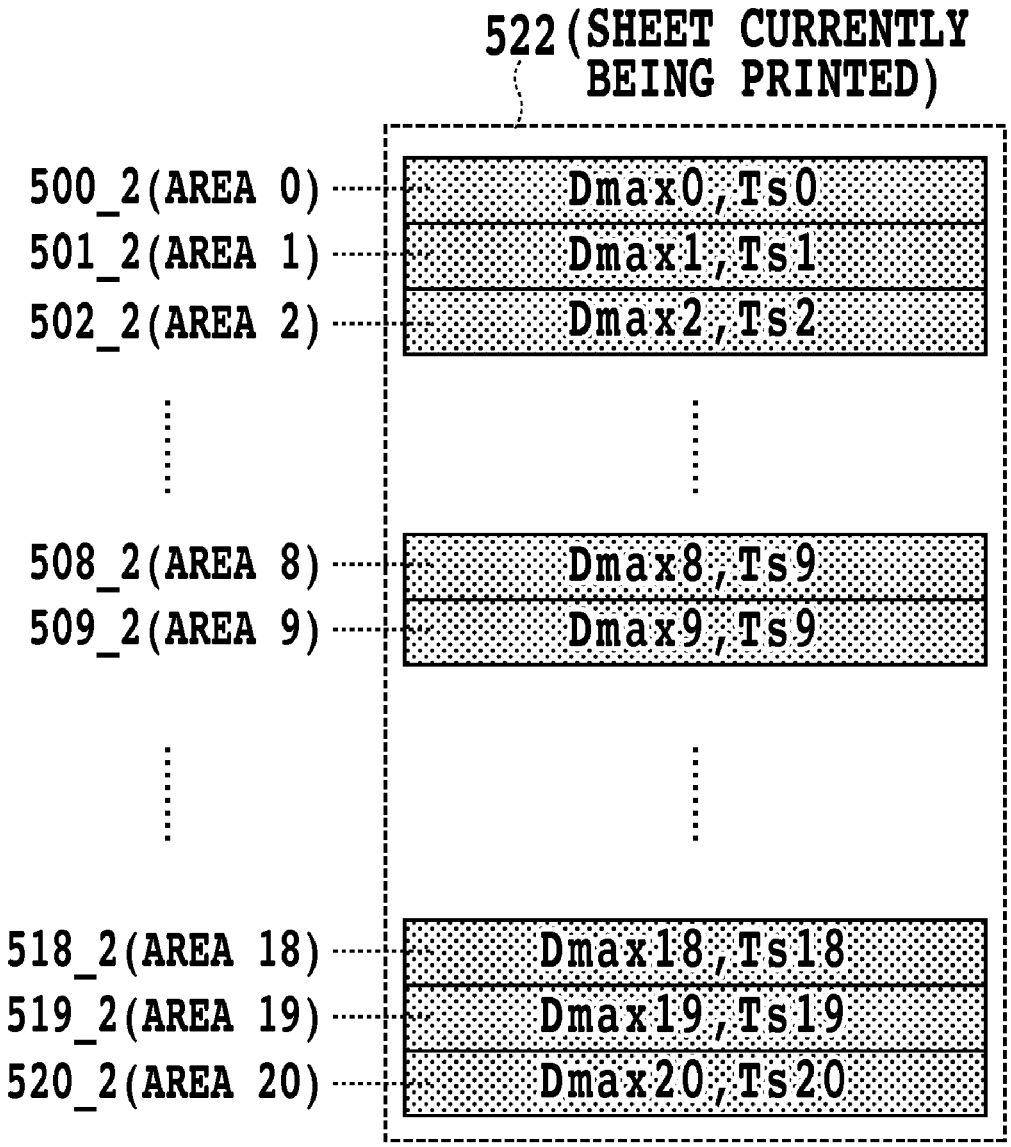
FIG. 9 is an explanatory diagram of information on printed sheets that has been updated using information on a sheet that has finished being printed during the basic print operation of the present invention.

After the printing of the sheet 522 is completed, Dmax and Ts, the information concerning the printed sheet 521, are cleared. Then, as shown in FIG. 9, Dmaxc and Tsc—information about the sheet 522 that has just been printed are stored as Dmax and Ts before clearing Dmaxc and Tsc. With the above process it is possible to set the next sheet in the same state as FIG. 4 when printing it.

Figure 10:
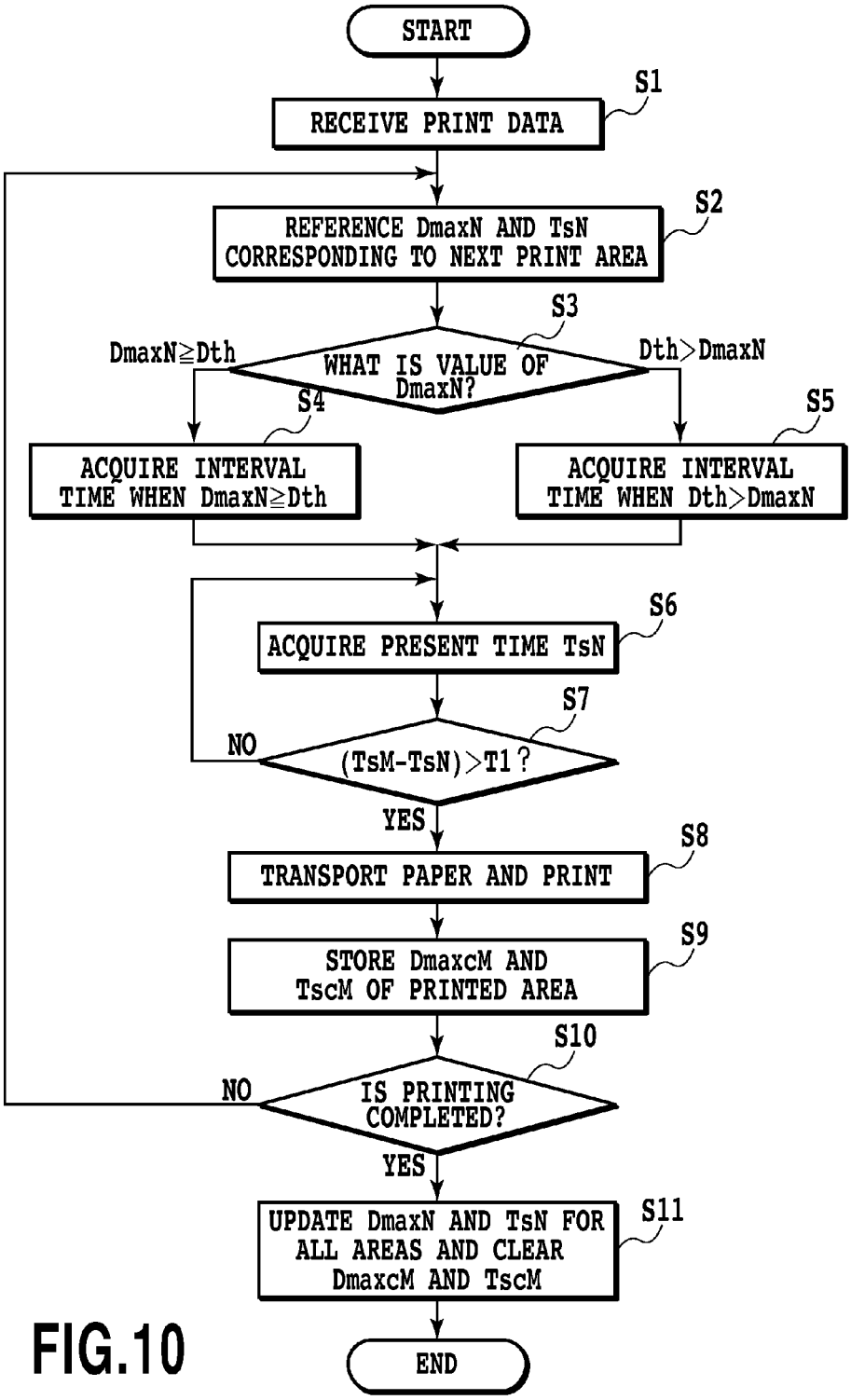
FIG. 10 is a flow chart showing a basic print operation of this invention.

FIG. 10 is a flow chart showing a sequence of steps executed by the above print operation.

Step S1: The controller receives print data and feeds a print sheet.

Step S2: The controller references information on area N (DmaxN and TsN) of the printed sheet 521 with that area M of sheet 522 to be printed next comes into contact. For example, in the state of FIG. 4, the controller references Dmax20 and Ts20 and, in the state of FIG. 5, Dmax19 and Ts19.

Step S3: The controller compares DmaxN referenced at step S2 with a predetermined threshold Dth. Dth is a value determined according to characteristics of ink used in the printing apparatus.

Step S4: The control acquires an interval time T1 required when DmaxN≧Dth. T1 may be prepared as shown in FIG. 11 in advance. T1, as with Dth, is a value determined according to the amount of ink applied to a unit area. T1 is a time it takes from when the sheet 521 has been printed until it can be contacted by the next printed sheet 522 without a problem, i.e., a time it takes for ink to become stable on the surface of the printed sheet 521. In the example of FIG. 11, Dth corresponds to 12,800 dots formed in the unit area and the interval time T1 required when DmaxN≧Dth is 10 seconds.

Step S5: The controller acquires an interval time T1 required when Dth>DmaxN. T1 may be prepared as shown in FIG. 11 in advance. In the example of FIG. 11, the interval time T1 required when Dth>DmaxN is 0 second.

Step S6: The controller acquires a present time TsM.

Step S7: The controller compares (TsM−TsN) with T1. (TsM−TsN) is a time that has elapsed from when the preceding sheet 521 has been printed to the present time. Therefore, if (TsM−TsN) becomes longer than T1, i.e., (TsM−TsN)>T1, ink is dry enough not to cause smearing. In that case, it is decided that there is no problem with proceeding to the next printing. If the decision is otherwise, there is a possibility that ink is not sufficiently dry. So, the printing is interrupted and the sheet 522 is not transported until the predetermined time T1 passes.

Step S8: Since it is confirmed at step S7 that the predetermined time T1 has passed, the controller transports the sheet 522 and executes its printing by scanning the print head.

Step S9: The controller stores in memory DmaxcM and TscM of the printed area.

Figure 12:
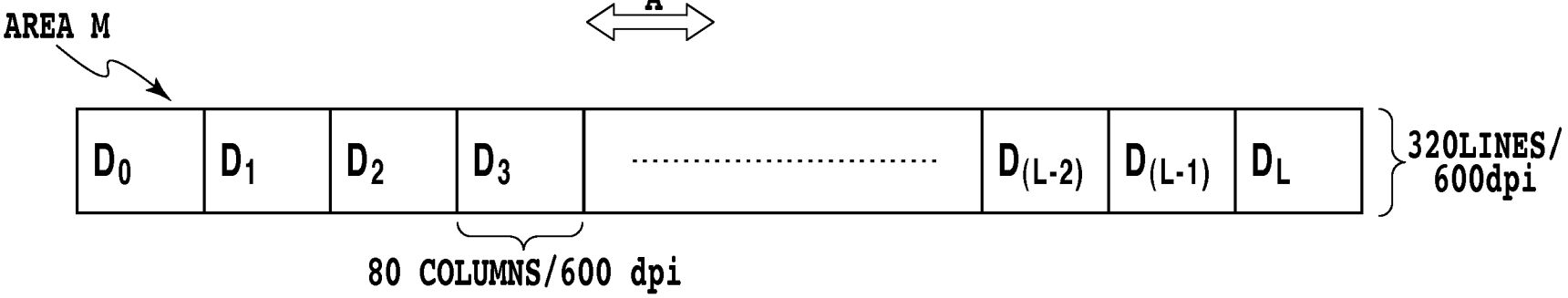
FIG. 12 shows a relation between a horizontal strip area or unit area and dot count areas making up the unit area on a print medium in a characteristic print operation performed in a first embodiment of this invention.

DmaxcM is calculated as follows. First, as shown in FIG. 12, the area M that has been printed is divided into a number of unit areas of a predetermined width (30 columns in this example) in the scan direction (X direction). The divided unit areas are referred to as dot count areas. In each of the dot count areas, the number of dots formed D0, D1, D2, . . . , DL is acquired and the largest of them is taken as the maximum number of dots DmaxcM in area M.

In the state of FIG. 4, for instance, the time that has elapsed from the point in time Ts20 when area 20 of printed sheet 521 has been printed to the present time TsM (Ts0), i.e., (Ts20−Ts0), is compared with the required time T1. After confirming that the elapsed time (Ts20−Ts0) has exceeded the required time T1, the area 0 of sheet 522 is printed (step S8). This is followed by storing in memory Dmaxc0 and Tsc0 of area 0 of sheet 522 (step S9).

Step S10: It is checked whether one page of sheet has been completely printed. If not, the controller returns to step S2, where it repeats the above processing until printing on one page is completed. When the printing on one page is finished, the controller proceeds to step S11.

Step S11: The controller updates the newly stored DmaxcM and TscM to DmaxN and TsN respectively (DmaxN=DmaxcM, TsN=TscM). That is, updating is done so that Dmax0=Dmaxc0, Dmax1=Dmaxc1 . . . . Then, DmaxcM and TscM are cleared. The controller then returns to the initial state, standing by for the next printing.

As explained above, the use of Dmax and Ts makes it possible to keep the sheet 522 waiting in un-transporting state for as long as necessary according to the print position of the sheet 522 in order to delay its printing operation.

However, since the "basic print operation" is based on the assumption that sheets of the print medium successively printed are of the same size and that the printed sheets are discharged at the same position, if the successively printed sheets have different sizes, the following problem may occur.

Figure 13C:
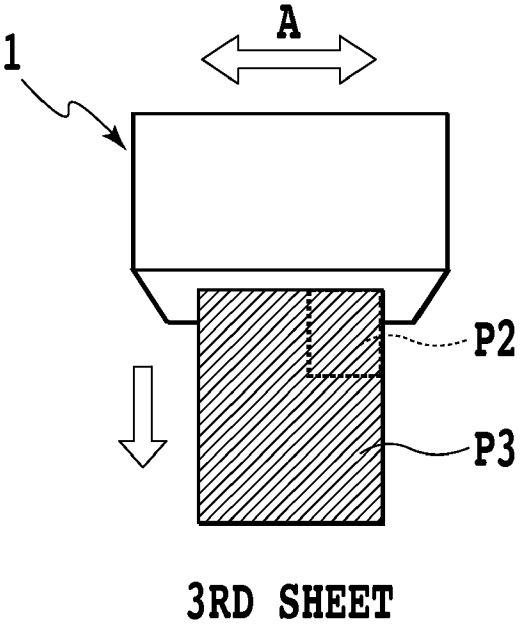
FIG. 13A, FIG. 13B and FIG. 13C are explanatory diagrams showing how print sheets of different sizes are printed successively.
Figure 13B:
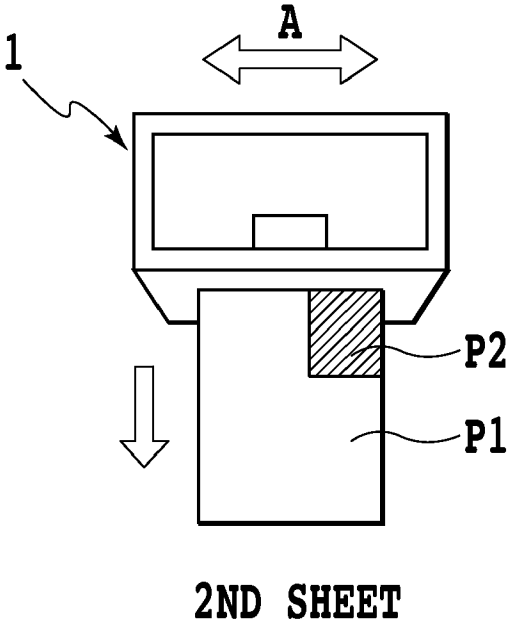
Figure 13A:
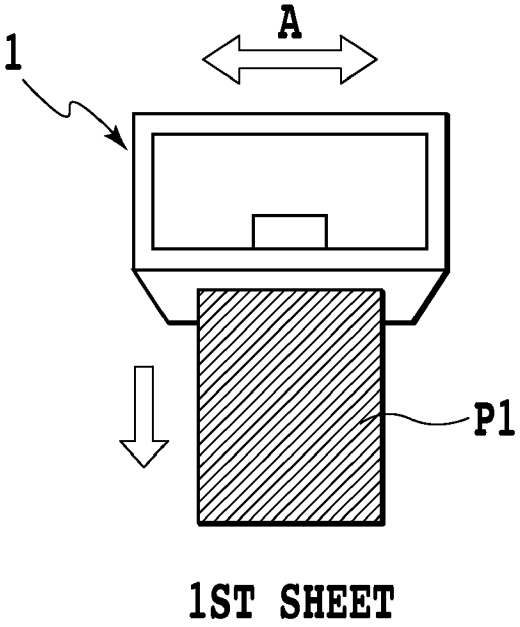

FIG. 13A shows a state in which an A4-size sheet P1 as a first print medium fed from a first paper supply port not shown has been printed with an image and then discharged onto a predetermined position. FIG. 13B shows a state in which an L-size sheet P2 as a second print medium fed from a second paper supply port not shown has been printed with an image and then discharged over the first printed sheet P1. If the second sheet P2 is smaller than the first sheet P1, as in this case, the two sheets P1, P2 overlap in a part of the width of the sheet P1. Therefore, as in the above "basic print operation", if Dmax is calculated for the entire width of the first sheet P1, there is a possibility of delaying (i.e., stopping) the print operation more than necessary.

FIG. 13C shows a state in which, after the second sheet P2 has been printed in FIG. 13B, an A4-size sheet P3 has again been fed as a third print medium from the first paper supply port, printed with an image and then discharged. In this case, since the "basic print operation" described above has updated the value of Dmax with that of the second sheet P2 of L size, Dmax of the first sheet P1 with which the sheet P3 actually comes into contact cannot be referenced. So, the printed surface of the sheet P1 and the back of the sheet P3 may get smeared.

Figure 14B:
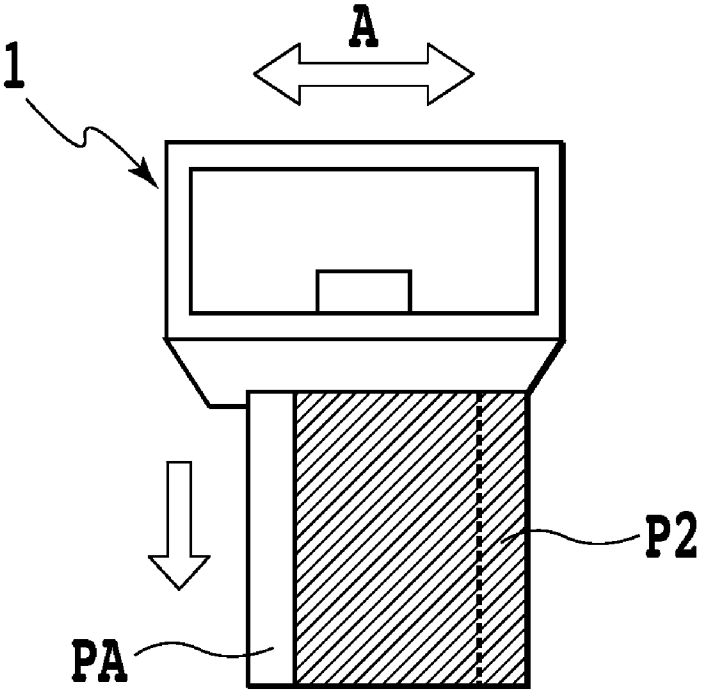
FIG. 14A and FIG. 14B are explanatory diagrams showing the second sheet of the same size as the first sheet being shifted laterally as it is discharged.
Figure 14A:
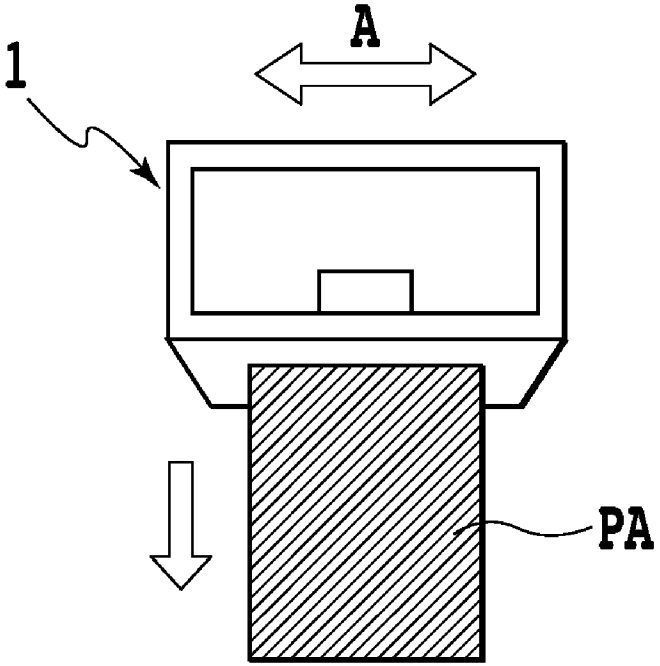

FIG. 14A shows a state in which a sheet PA as a first print medium has been fed from the first paper supply port not shown, printed and discharged onto a predetermined position. FIG. 14B shows a state in which, following the state of FIG. 14A, a sheet PB of the same size as the sheet PA has been fed as a second print medium from the second paper supply port not shown, printed and discharged onto the first printed sheet PA.

If the reference positions of sheets in the first and second paper supply port differ, the sheets PA, PB may get laterally shifted when stacked as shown in FIG. 14B. So, if the maximum density Dmax in the entire range of width of the first sheet PA is used as in the "basic print operation" described above, there is a risk of delaying the print operation more than necessary.

Variations in the sheet reference position in each paper supply port may, for example, occur in the following situations.

Figure 15:
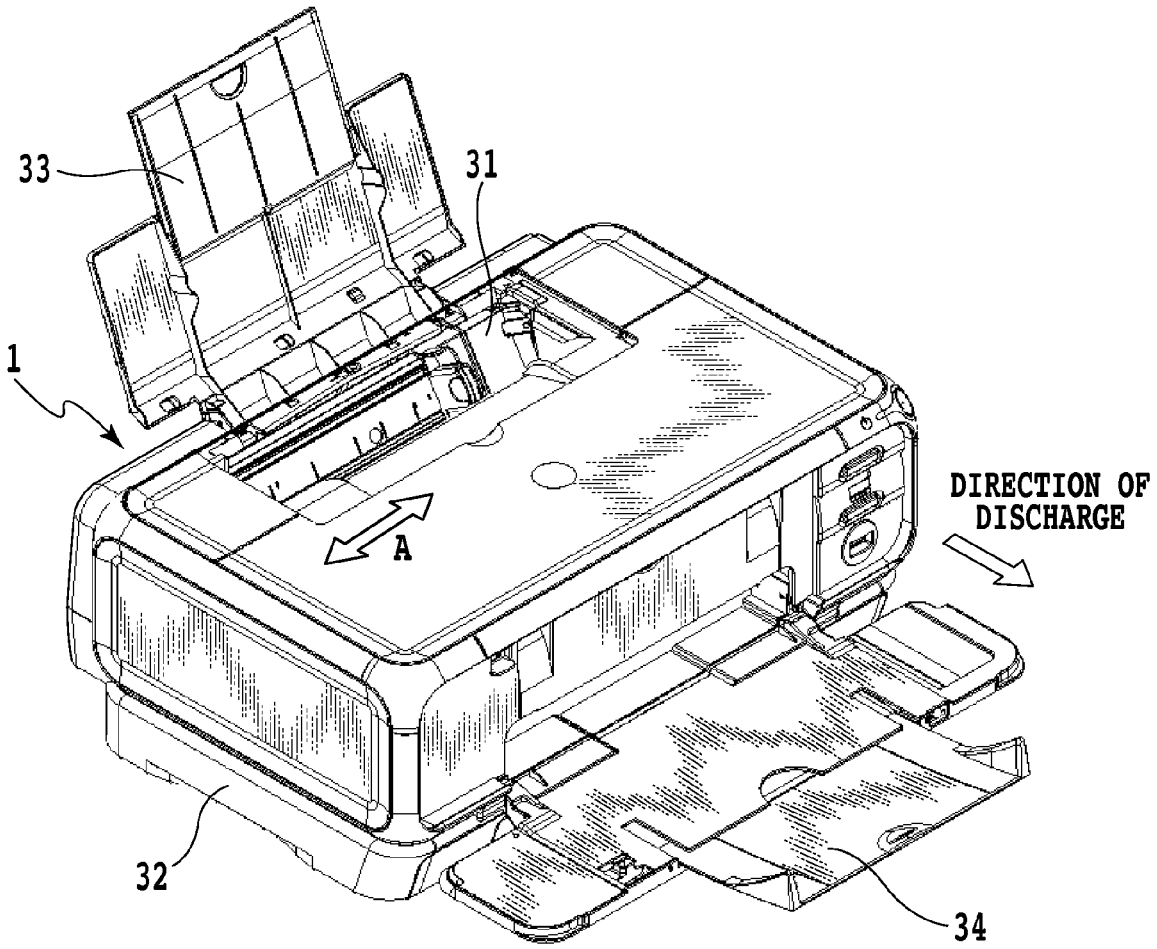
FIG. 15 is a perspective view of a printing apparatus with two sheet supply ports.

FIG. 15 shows another embodiment of the printing apparatus 1. This printing apparatus 1 has a first paper supply port 31 installed at the back of the apparatus body and a second paper supply port 32 at the bottom. The second paper supply port 32 is able to feed print sheets from the front of the printing apparatus and having the advantage of high operability. Since the print sheet fed from the second paper supply port 32 is U-turned to be carried to the print unit, the feed precision of sheets supplied from the second paper supply port 32 is relatively low. Therefore, the printing apparatus is configured so that special paper such as plain paper is fed from the first paper supply port 31. The first paper supply port 31 is configured so that the center of the transport roller 14 in the scanning direction is made a reference for sheet feed position and sheet transport position to improve transport precision of the print sheet. The second paper supply port 32 on the other hand is configured so that a portion deviated from the center of the transport roller 14 in the scanning direction is made a reference for sheet feed position and sheet transport position.

A discharged paper tray 34 on which printed sheets coming out of the printing apparatus are received is pulled forward from the printing apparatus when in use. Since the reference for sheet feed position of the sheet supplied from the first paper supply port 31 is different from that of sheet supplied from the second paper supply port 32, these sheets are stacked on the discharge paper tray 34 so as to be laterally shifted in the scanning direction.

If the reference positions differ as described above, the sheet PA supplied from the first paper supply port 31 and the sheet PB supplied from the second paper supply port 32 are stacked laterally shifted on the discharged paper tray 34, as shown in FIG. 14B.

In this embodiment, to deal with problems that may be experienced when a print operation is executed successively on print sheets of different sizes and also when the stacking positions of printed sheets are shifted, the following "characteristic print operation" is performed. In the explanation that follows, portions similar to those of the aforementioned "basic print operation" are omitted.

"Characteristic Print Operation"

Figure 16:
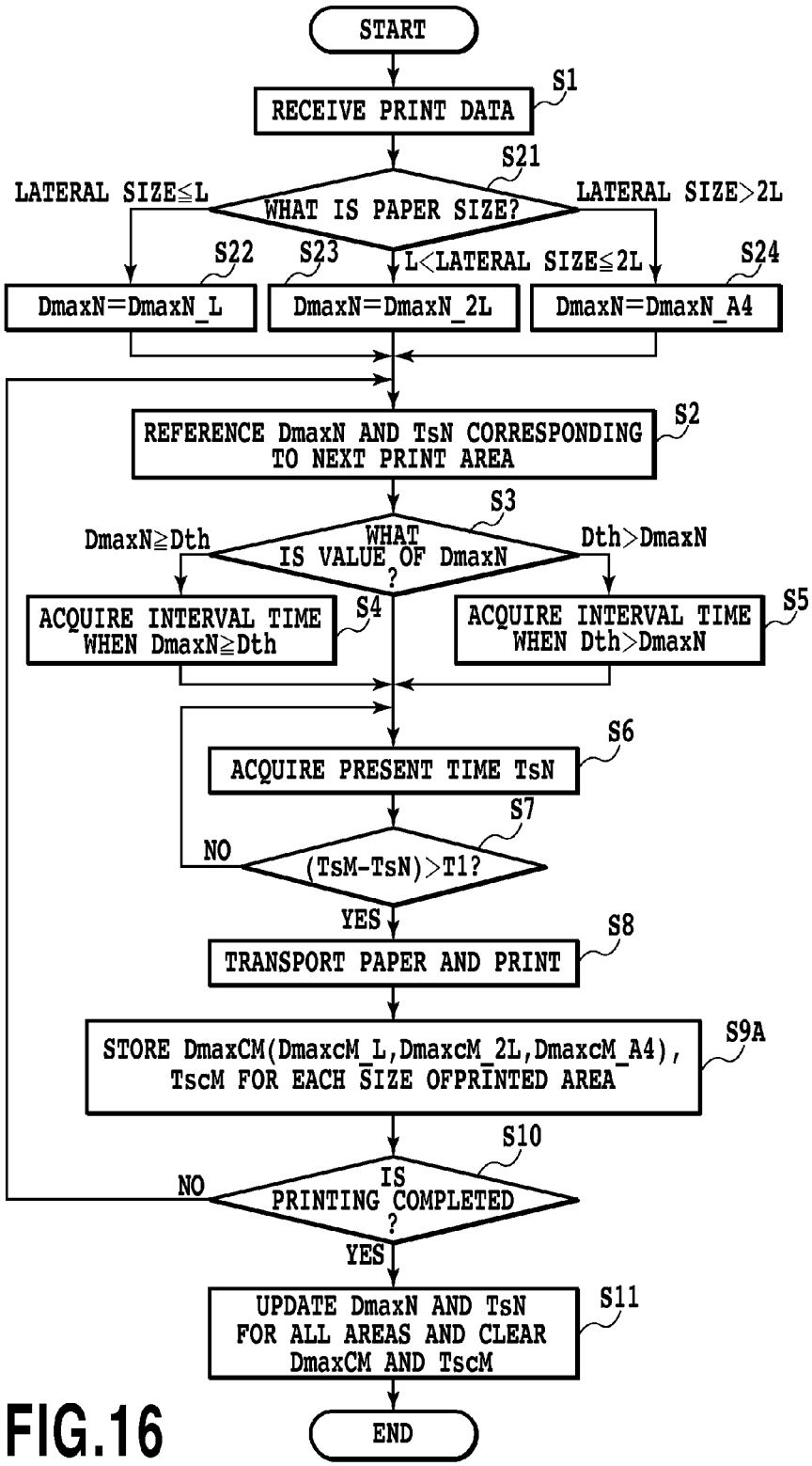
FIG. 16 is a flow chart showing a characteristic print operation in the first embodiment of this invention.

FIG. 16 is a flow chart showing a sequence of steps executed in the "characteristic print operation" of this embodiment. In FIG. 16, similar step numbers are assigned to the same steps as those of FIG. 10 and their explanations are omitted. Compared to the flow chart of FIG. 10, the flow chart of FIG. 16 has additional steps S21, 22, 23, 24 and also has step S9A changed from step S9 of FIG. 10. These steps will be explained as follows.

Step S21: The controller checks a horizontal size (width size) of a sheet.

A width of the print sheet is acquired from header information transmitted with print data from the host device 210 via the interface 211. The header information may be added with information (e.g., L, 2L, A4) for indicating the size of the print sheet or information on the width and length of the print sheet. In this embodiment, print sheets are classed into three different size groups: a group equal to or less than L size, a group greater than L size and equal to or less than 2L size, and a group greater than 2L size.

Step S22: When it is decided that the sheet is equal to or less than L size, DmaxN_L prepared for L size as described later is chosen as DmaxN.

Step S23: When the sheet is found to be greater than L size and equal to or less than 2L size, DmaxN__2L prepared for 2L size as described later is chosen as DmaxN.

Step S24: When the sheet is found to be greater than 2L size, DmaxN_A4 prepared for sizes greater than 2L as described later is chosen as DmaxN.

Step S9A: DmaxcM (DmaxN_L, DmaxN__2L, DmaxN_A4) and TscM for each size of printed areas are stored.

Figure 17:
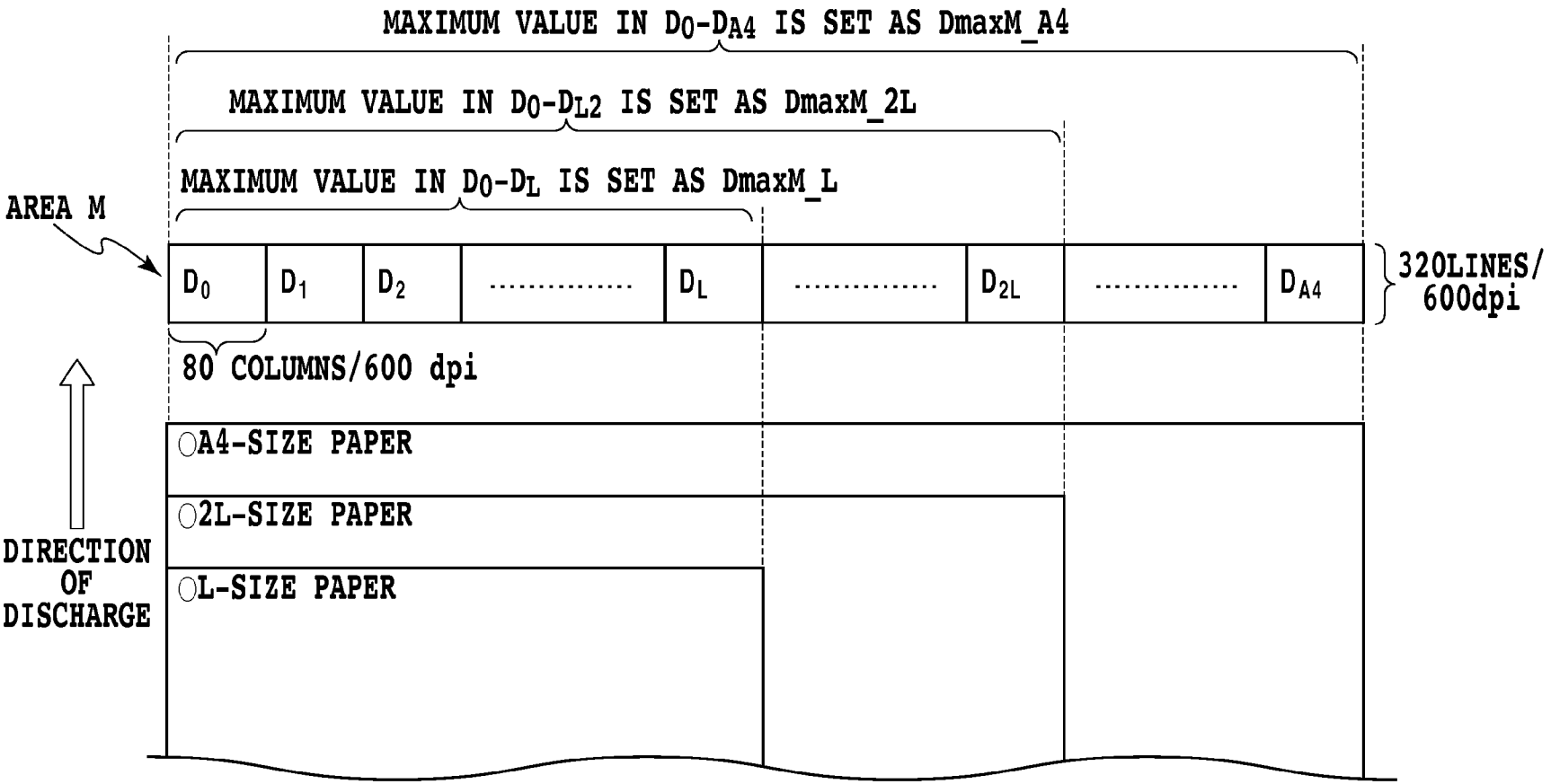
FIG. 17 shows a relation between print sheet sizes and the maximum number of dots in the print operation of FIG. 16.

FIG. 17 schematically shows a relation among the widths of L-, 2L- and A4-size sheets, dot count areas and DmaxcM (DmaxN_L, DmaxN__2L, DmaxN_A4).

In FIG. 17, dot count areas D0 to DL represent unit areas to be printed when an L-size sheet is printed, the number of dots formed in each of the dot count areas D0 to DL being referred. Likewise, dot count areas D0 to D2L represent unit areas to be printed when a 2L-size sheet is printed, the number of dots formed in each of the dot count areas D0 to D21, being referred; and dot count areas D0 to DA4 represent unit areas to be printed when an A4-size sheet is printed, the number of dots formed in each of the dot count areas D0 to DA4 being referred. DmaxN_L is the maximum number of dots in the dot count areas D0 to DL; DmaxN__2L is the maximum number of dots in the dot count areas D0 to D2L; and DmaxN_A4 is the maximum number of dots in the dot count areas D0 to DA4.

More specifically, an example case is considered in which a first sheet of A4 size is supplied from the paper feed unit 5*a* of FIG. 1 and printed with an image, followed by a second sheet of L size being supplied from the paper feed unit 5*b* of FIG. 1 and printed with an image. In this case, the first sheet P1 in FIG. 13A and FIG. 13B is A4 size and the second sheet P2 is L size. One example of values will be explained using the interval time T1 and threshold Dth of FIG. 11 and DmaxN, TsN, DmaxcM and TscM of FIG. 18 to FIG. 20. In FIG. 11, as described earlier, the threshold Dth is set at 12,800 dots. If DmaxN is in excess of the threshold Dth, the interval time T1 is set to 10 seconds and, if DmaxN is smaller than Dth, the interval time T1 is set to 0 second.

FIG. 18 shows a relation between areas in the first sheet (A4 size) and DmaxN and TsN. In FIG. 18, a first column from left represents areas and a second column represents DmaxN_L, or the maximum number of dots DmaxN in the dot count areas D0 to DL corresponding to the horizontal width of L size. A third column represents DmaxN__2L, or the maximum number of dots DmaxN in the dot count areas D0 to D2L corresponding to the horizontal width of 2L size. A fourth column represents DmaxN_A4, or the maximum number of dots DmaxN in the dot count areas D0 to DA4 corresponding to the horizontal width of A4 size. In area 0, for example, the maximum number of dots Dmax0_L in the dot count areas D0 to DL, the maximum number of dots Dmax0__2L in the dot count areas D0 to D2L and the maximum number of dots Dmax0_A4 in the dot count areas D0 to DA4 are all 2,900 dots. A fifth column in FIG. 18 represents a print time TsN.

FIG. 19 and FIG. 20 show an example of DmaxcM values while the second sheet (L size) is printed, with FIG. 19 representing DmaxcM when printing is completed up to area 3 and FIG. 20 representing DmaxcM when printing is finished up to the final area 8. In FIG. 19 and FIG. 20, a second column shows DmaxcM_L as the maximum number of dots DmaxM in the dot count areas D0 to DL corresponding to the horizontal width of L size. A third and a fourth columns indicate the maximum number of dots DmaxcM__2L in the dot count areas D0 to D2L corresponding to the horizontal width of 2L size and the maximum number of dots DmaxcM_A4 in the dot count areas D0 to DA4 corresponding to the horizontal width of A4 size, respectively. Here, since the second sheet currently being printed is of L size, the values of DmaxcM_L in the second column are stored as is in the third and fourth columns.

In FIG. 19 and FIG. 20, a fifth column represents a print time Tsc and a sixth column represents (Tsc−TsN). If the value of (Tsc−TsN) is equal to or less than the interval time T1, the transporting of the print sheet is interrupted and the print operation is delayed until the time T1 is reached. When the second sheet is L size as in this example, the value of (Tsc−TsN) is always equal to or less than 10 seconds. So, when the maximum number of dots DmaxcM exceeds the threshold Dth, the print operation is definitely delayed because T1 is 10 seconds (see FIG. 11).

Here, an example case is considered in which the maximum number of dots DmaxN is set for each area without taking the area size, i.e., the horizontal width of a sheet, into account, as with the "basic print operation" described above. In this case, for area 18 in FIG. 18, for example, only the maximum value of 13,000 is set as DmaxN. Since, before area 2 of FIG. 19 that references area 18 is printed, a relation of DmaxN≧Dth holds, the print operation is delayed until interval time T1 reaches 10 seconds. However, with the "characteristic print operation" of this embodiment, Dmax18_L=9300 is adopted as DmaxN of area 18 in FIG. 18, so that unnecessary delay can be eliminated.

In this example, tables of FIG. 18 to FIG. 20 are set for paper sizes of L, 2L and A4. The table setting, however, is not limited to such sizes and categories but may be made as required by the printing apparatus, for example, by preparing tables that apply only to L and A4 sizes or 4"×6" and 5"×7" sizes.

The above "characteristic print operation" is effectively applied not only to the printing of print mediums of different sizes but also to the printing that shifts printed mediums from one another in a widthwise direction as they are discharged and stacked one upon the other as shown in FIG. 14A and FIG. 14B.

For example, in the printing apparatus of FIG. 15, if the reference positions of sheets fed from the first and second paper supply ports 31, 32 differ, the discharge positions of the printed sheets P1, P2 will be shifted in a widthwise direction even if they are of the same size, as shown in FIGS. 14A and 14B. So, the maximum number of dots DmaxN in a width range where the sheets P1, P2 actually overlap is stored for each area, as in the "characteristic print operation" of this embodiment. This allows an optimum delay time of the printing operation to be set based on the DmaxN, eliminating unnecessary delays.

Where the reference positions of sheets supplied from the first and second paper supply ports 31, 32 differ as described above, a DmaxN-TsN correspondence table, such as shown in FIG. 21, may be used to present DmaxN and TsN for all dot count areas (D0, D1, This makes it possible to check the necessity for delaying the print operation by referencing an area determined by the paper supply source (first or second paper supply port). If the delay is found necessary, the print delay time can be set for each unit area (0, 1, . . . ) composed of a plurality of dot count areas, based on the dot count area which most requires the delay time of the printing operation.

Furthermore, the present invention can be applied to the printing apparatus in which the reference for sheet feed position of the sheet supplied from the first paper supply port 31 is different from that of sheet supplied from the second paper supply port 32, and the print mediums of different sizes are fed from each of the paper supply port 31 and 32. In this case, the maximum number of dots DmaxN in the overlapping area between the print sheet currently being printed (preceding medium) and the print sheet already printed sheet (following medium) may be acquired based on information about the paper supply source (first or second paper supply port) and information about the size of the preceding medium. Thus, the delay time of the printing operation can be set based on the acquired maximum number of dots DmaxN.

Second Embodiment

In addition to the construction of the first embodiment, this embodiment considers printing a third sheet P3, as shown in FIG. 13C.

In the first embodiment, DmaxcM of an L-size sheet currently being printed (second sheet), such as shown in FIG. 19 and FIG. 20, is updated as DmaxN of a preceding printed sheet after the current printing is finished, in preparation for the next sheet (third sheet). FIG. 22 shows an example case where, after the second L-size sheet has been printed, DmaxcM of the second sheet is updated as DmaxN. FIG. 23 shows DmaxcM when the third sheet of A4 size is printed with the same print data that was printed on the first A4-size sheet.

A storage area of DmaxcM of FIG. 22 differs from that of FIG. 19 and FIG. 20. The reason for this is that the printed sheet is discharged by setting the area on the front end side of a paper feed direction as area 0 as shown in FIG. 4 and taking the rear end side of the paper feed direction as a reference for positioning as shown in FIG. 13C. When DmaxcM of the second L-size sheet is updated as DmaxN, areas 0 to 11 do not exist. In this example, "0 dot" is set in these areas 0 to 11.

In FIG. 23, first to sixth column from left represent areas, DmaxcM for each of three different paper sizes, a print time Tsc and an elapsed time Tsc−TsN, as in FIGS. 19 and 20. A seventh column in FIG. 23 shows, for additional information, a time duration (Tsc−TsN) that has passed from when the first sheet has been printed. In the sixth and seventh columns in FIG. 23, shaded cells (areas 0 to 20 in the sixth column and areas 0 to 6 in the seventh column) represent elapsed times that have not exceeded the predetermined time T1 of 10 seconds. This means that these areas may need a print delay depending on DmaxN.

When DmaxN of FIG. 22 is used, as in the sixth column of FIG. 23, there is no print delay. However, in practice, it is obvious as shown in FIGS. 13A, 13B and 13C that the first sheet P1 and the third sheet (currently being printed) P3 will come into contact with each other. In this example, as DmaxN that is updated when the printing of the second sheet is finished, 13,000 (dots) is stored in Dmax18_A4 of area 18 of the first sheet, as shown in FIG. 18. Therefore, the printing of the third sheet P3 should be delayed, considering the interaction with the first sheet P1.

This embodiment is constructed to take into consideration the overlapping of the first, second and third sheet P1, P2, P3 described above.

FIG. 24 is an example of table showing a relation between DmaxN and TsN used in this embodiment.

The table of FIG. 24 differs from the table of FIG. 18 of the first embodiment in the following three points.

Figure 25:
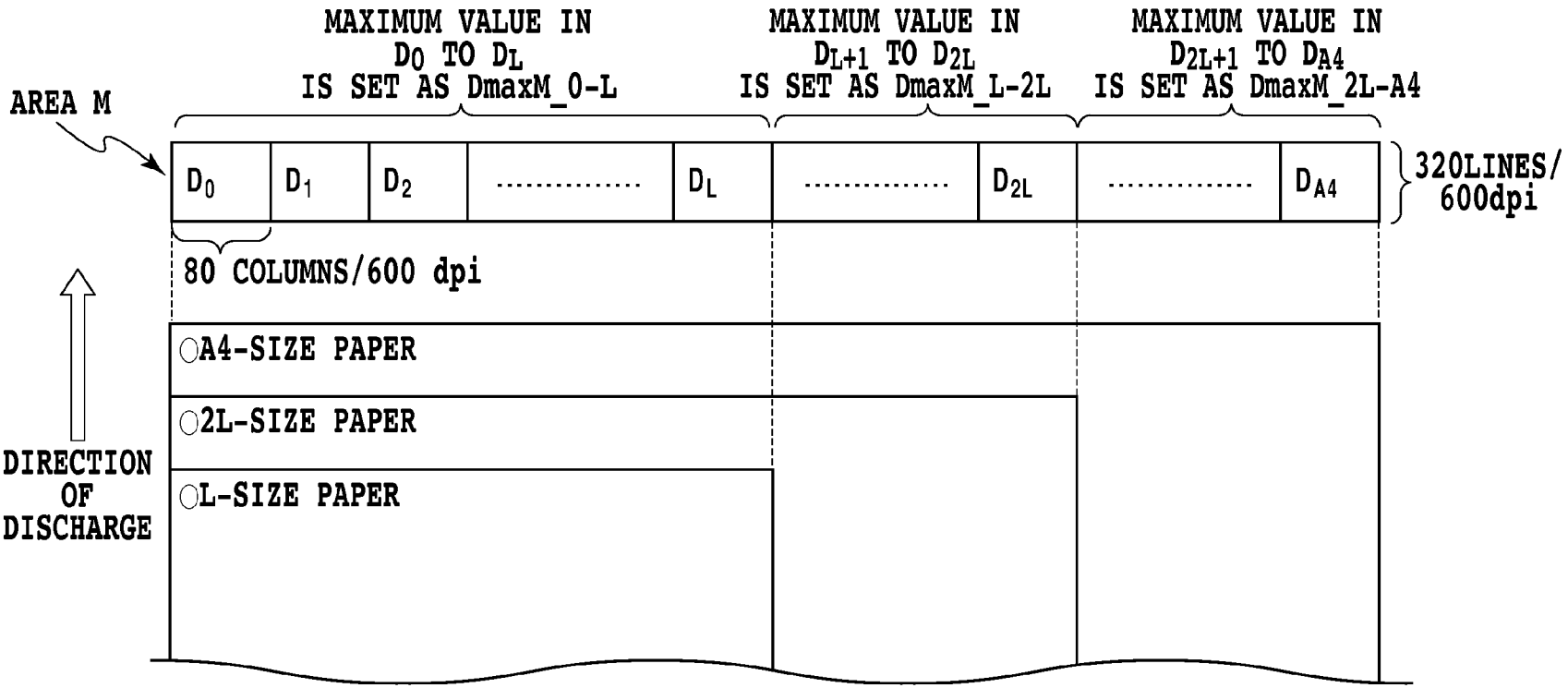
FIG. 25 is a table showing a relation between a print sheet size and the maximum number of dots in the second embodiment of this invention.

(1) Each of the unit areas is divided into dot count area groups D0 to DL, DL+1 to D2L, and D2L+1 to DA4, as shown in FIG. 25. So, DmaxN+2L−A4 in the dot count area group D2L+1 to DA4 of unit area 5 and 6, for example, may differ from DmaxN_A4 of unit area 5 and 6 in FIG. 9.

(2) TsN is stored in each of the dot count area groups D0 to DL, DL+1 to D2L, and D2L+1 to DA4.

(3) When updating DmaxM to DmaxN, only the value of newly printed areas is updated.

For example, in the first embodiment, only the values of DmaxN and TsN in the shaded cells of FIG. 24 are updated with DmaxcM and TscM of the unit area in the second L-size sheet. In other cells the values of DmaxN and TsN of the first sheet are kept. For DmaxcM and TscM, too, the values are similarly stored in each unit area.

As described above, information is kept in a table such as shown in FIG. 24 and, in making a decision on Dmax for each horizontal strip, all unit areas necessary for that decision making are considered and a delay time is set according to the value of Dmax determined.

For example, if the third sheet P3 is of L size, DmaxN and TsN in the unit area D0 to DL are referenced to see if a delay is needed. If the sheet is of A4 size, reference is made to DmaxN and TsN in the unit area D0 to DL, unit area DL+1 to D2L and unit area D2L+1 to DA4.

With such processing executed, the print delay time can be set more appropriately according to the state of overlap among the first, second and third sheet, i.e., the amount of shift among them in the discharged position. The discharge position shift among these sheets occurs not only when their sizes differ as shown in FIGS. 13A, 13B and 13C but when the sheets of the same size shift laterally as shown in FIGS. 14A and 14B. Circumstances where such a discharge position shift occurs are not particularly limited. It is also possible to set the print delay time by taking the overlapping of four or more sheets into account.

The smearing of printed sheets caused by three or more sheets overlapping each other becomes more likely as the time it takes to print one sheet of print medium decreases. So, if there is no possibility of smearing, a simple construction such as described in the first embodiment can be adopted, while this second embodiment can be used when the possibility of smearing exists.

Other Embodiments

Although in the above embodiments one threshold Dth for the maximum number of dots Dmax is prepared to determine the delay time of the printing operation, it is desired that two or more of the thresholds Dth be used.

Figure 26:
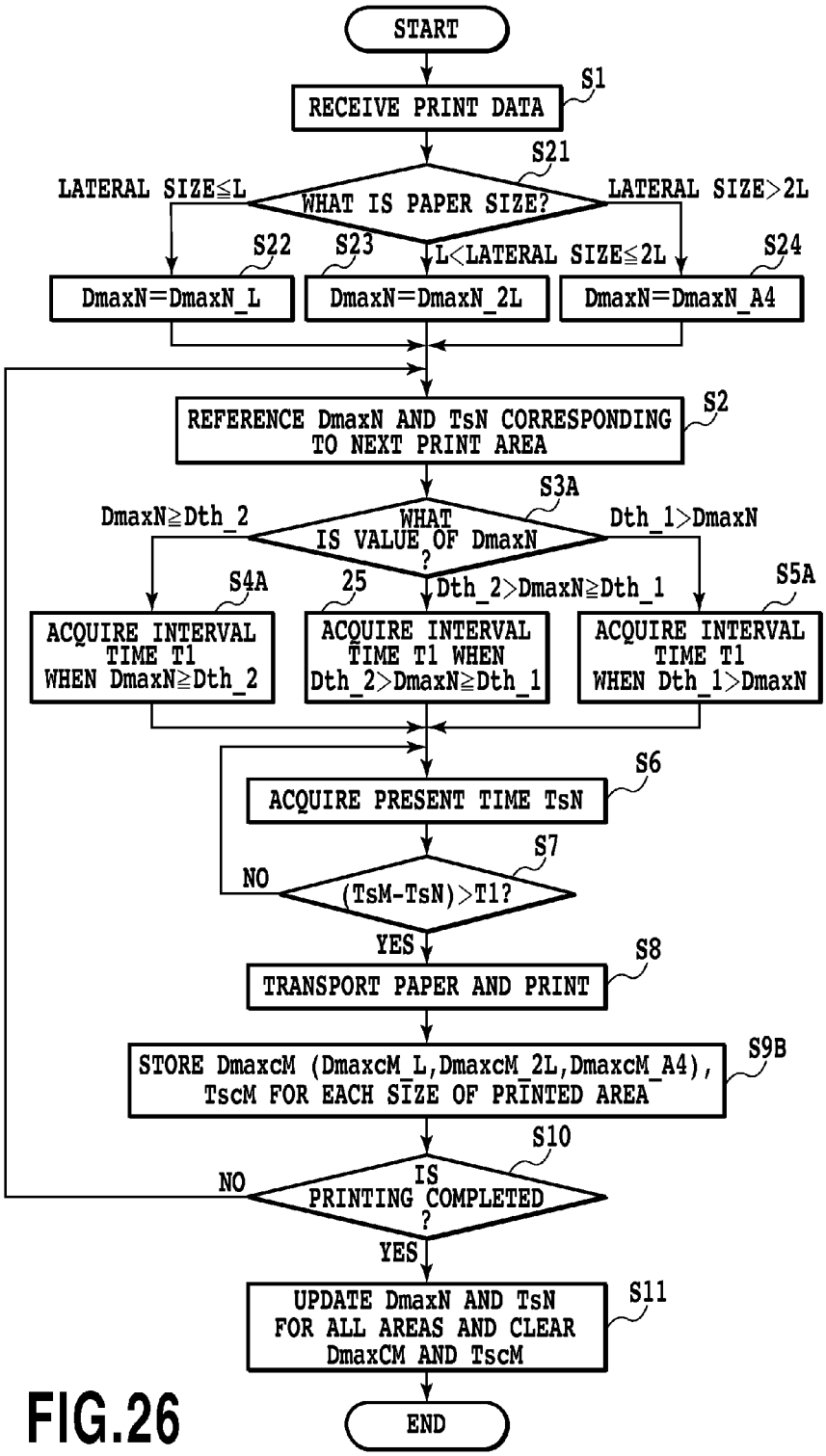
FIG. 26 is a flow chart showing a print operation in another embodiment of this invention.

FIG. 26 is a flow chart showing a sequence of steps when two thresholds Dth_1 and Dth_2 are used. FIG. 27 shows interval times T1 set by the two thresholds. FIG. 26 differs from the flow chart of FIG. 16 in that step S3, S4, S5 are changed to step S3A, S4A, S5A and that another step S25 is added. The use of two thresholds as shown in FIG. 27 allows the maximum number of dots Dmax to be compared to the two thresholds Dth_1 and Dth_2. In this embodiment, five density ranges are set according to the characteristics of ink and print medium used and, for each density range, the maximum number of dots Dmax is compared to the two thresholds Dth_1 and Dth_2. As the level increases, the interval time T1 increases, prolonging the waiting time during which ink is dried. In this embodiment, the interval times T1 is further divided into five sub-levels according to the printing speed and print quality required of the printing apparatus.

Using a plurality of thresholds as described above enables the print delay time to be set more finely according to the print density, realizing its optimization. Some printing apparatus allows the print quality to be set from a printer driver, in which case the interval time T1 may be set according to the print quality.

Figure 8:
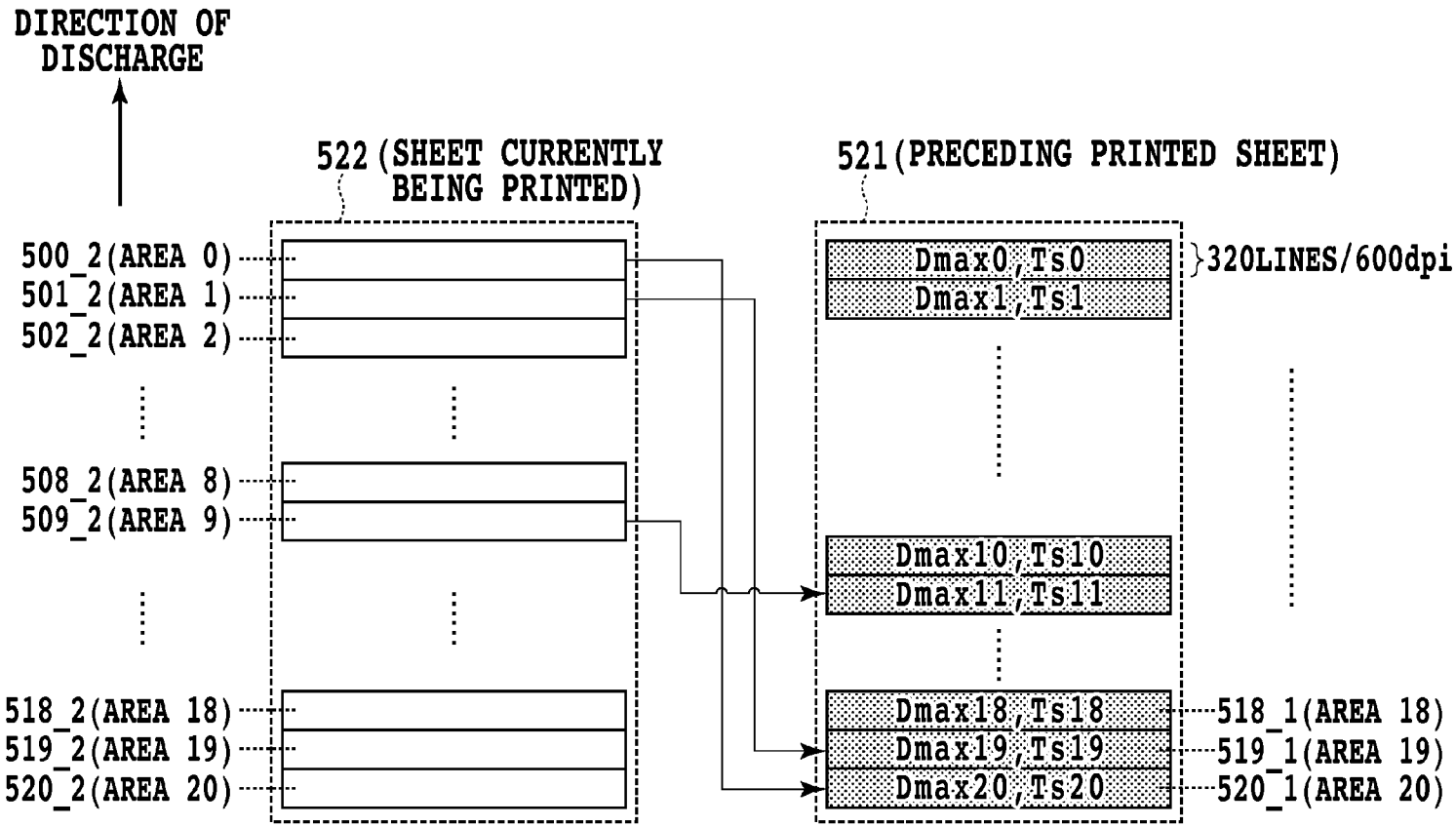
FIG. 8 shows a matching relation between horizontal strip areas of a sheet being printed and horizontal strip areas of an already printed sheet during the basic print operation of the present invention.
Figure 28:
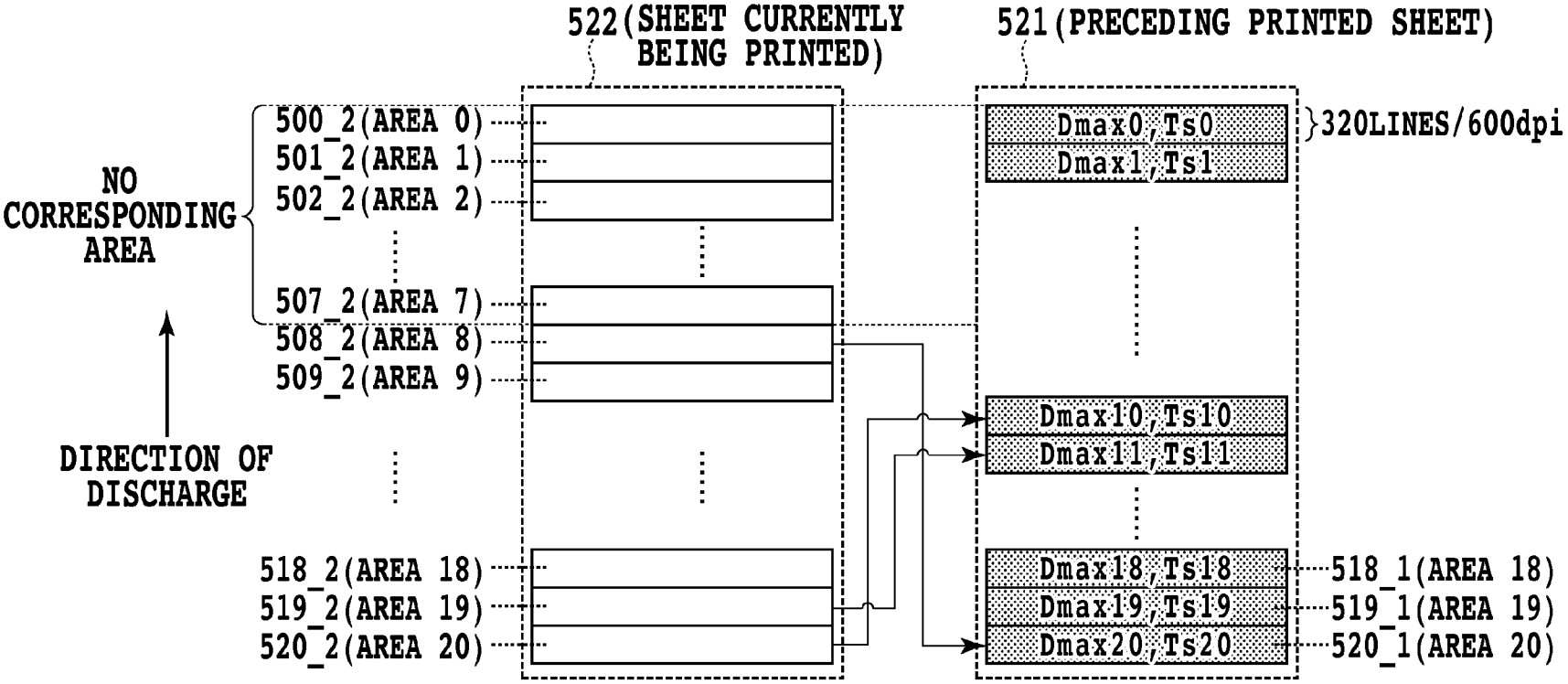
FIG. 28 shows a matching relation between horizontal strip areas of a sheet being printed and horizontal strip areas of an already printed sheet in still another embodiment of this invention.

In the above embodiments, horizontal strip areas of a second sheet 522 currently being printed are related, as shown in FIG. 8, to those horizontal strip areas of a first, already printed sheet 521 which are referenced when the horizontal strip areas of the second sheet are printed. The matching relationship between them is not limited to the one shown in FIG. 8. For example, as shown in FIG. 28, the rear-end area 20 of the already printed sheet 521 may be referenced when area 8 of the sheet 522, which is currently being printed, begins to be printed. That is, when areas 8, 9, 10, of the sheet 522 (following medium) are printed, references may be made to areas 20, 19, 18, of the already printed sheet (preceding medium) 521. The relationship between the areas of the preceding medium and the areas of the following medium may be determined according to a height of the sheet discharged position (discharged paper tray) and the distance between the position of the print head and the paper discharge position. The relationship between the areas of the preceding medium and the areas of the following medium may be changed on the basis of print conditions. For example, hardness of a print medium varies with the type of the print medium, and a position on the preceding medium to which the following medium is contact is changed according to the hardness of the print medium. The hardness of a print medium also varies according to the environmental humidity, and a position on the preceding medium to which the following medium is contact is changed according to the environmental humidity. Therefore, it is desired to change the relationship between the areas of the preceding medium and the areas of the following medium based on at least one of information about type of the print medium acquired from command for printing and the environmental humidity acquired by the humidity sensor 233.

In the above embodiments, an area of the print medium on which the print head is passed by one scan is divided in the scanning direction into the plurality of dot count areas where the number of dots is counted. However, the dot count areas are not limited to that. That is, the dot count areas can be appropriately set according to how to contact the following medium to the preceding medium at the sheet discharged position. The count areas may be areas into which the preceding medium is divided in the scanning direction and the transporting direction, and the size of the dot count area and the like are not limited.

With the area-to-area relation set as shown in FIG. 28, Dmax of areas 0 to 7 in the printed sheet 521 are not referenced. The dot count value in the form of Dmax in these areas can be used to manage the time that passes from the end of printing to the sheet being discharged completely. That is, for those areas on the front end side in the paper transporting direction that have not been referenced, the interval time T1 is determined from the result of comparison between maximum number of dots Dmax and Dth and comparison between TsM and TsN. Then, according to whether the interval time T1 has been reached, a decision on whether or not to execute a paper transport delay operation is made. In this delay operation, too, by limiting Dmax to be referenced to only the necessary locations according to the size of the sheet, unnecessary delays can be avoided as in the preceding embodiments.

Further, in the preceding embodiments, it is assumed that all the inks provided in the printing apparatus are subjected to the dot counting, i.e., the number of dots formed are counted for all inks. However, a dye ink containing a dye component quickly penetrates a print medium and settles there. So, the dot count may be implemented only on pigment inks containing pigment components without considering the dye inks. That is, the delay time for printing operation may be set by taking only the pigment inks into consideration.

The printing apparatus may have a plurality of paper supply ports from which different sizes of print sheets are fed, and still can produce a similar effect. Three or more of such paper supply ports may be used.

Further, in the preceding embodiments, the maximum number of dots Dmax in a plurality of unit areas belonging to each of the horizontal strip areas is compared with a predetermined threshold Dth to delay the printing operation. However, the construction of this invention is not limited to those described above. It may, for example, be possible to set the delay time for printing operation by comparing a total number of ink dots in the unit area in which the preceding sheet (preceding medium) and the subsequent sheet (following medium) come into contact with each other to a predetermined threshold. If, following the discharge of A4 sheet, a 2L sheet is to be discharged as shown in FIG. 18, the total number of ink dots in the unit area D0 to D2L of the A4 sheet needs only to be compared to the threshold to set the delay time while the 2L sheet is printed. In essence, this invention is characterized in that, while the subsequent sheet is printed, the delay control is performed according to information about an amount of ink of an area in which the first discharged sheet and the next discharged sheet are contact. A variety of ways are conceivable for determining the delay time. The information about the amount of ink is not limited to the number of dots. A value calculated by multiplying the number of dots by ink ejection amount per one ink droplet may be applied as the information about the amount of ink.

In the delay control of the above embodiments, waiting time for transporting the print sheet is set. However, the construction of this invention is not limited to those described above. For example, the transporting time of the subsequent sheet may be delayed by slowing the moving speed of the carriage mounted with the print head.

In the printing apparatus such as the above embodiments, the print sheets of different sizes are successively printed. In such a configuration, printing job may be divided by a page, and header information including information on the size of the print sheet may be added to each of the divided printing job. Alternatively, printing job may not be divided, and the information on the size of the print sheet may be added to the printing job by a page.

(Others)

The present invention is applicable to a wide variety of types of ink jet printing apparatus that transport a printed medium, which has been printed with an image using an ink ejecting print head, in a discharge direction onto a predetermined discharge position. The printing apparatus capable of applying this invention, therefore, is not restricted to only a serial scan type that forms an image on a print medium by moving the print head in a main scan direction (first direction) and transporting the print medium in a subscan direction (second direction). For example, the printing apparatus may be of a full-line type that forms an image on a continuously moving print medium by using a print head that extends over an entire width of a print surface of the print medium.

The printing apparatus capable of applying this invention may also be one that transports the print medium to a discharge position while forming an image on it, or one that sends the print medium to the discharge position after the image has been formed on it. Further, the printing apparatus may have a plurality of paper supply ports capable of feeding different sizes of print medium. Moreover, the plurality of paper supply ports may use different reference positions for sending the printed mediums to the discharge position.

Suppose a print medium discharged first to a discharge position is referred to as a first print medium. A print surface of the first print medium is divided into a plurality of areas and information on ink applied to each of the divided areas is stored. The information may include a print density of an image formed by the ink ejected onto each of the divided area and an ink ejection time for a predetermined number of the divided areas. The print density may be related to the number of ink dots formed in the area. The ink ejection time may be stored for each of the divided areas or commonly for a plurality of divided areas. The plurality of divided areas may be aligned in at least one of the discharge direction (predetermined direction) and a direction crossing the discharge direction.

Assuming that a print medium discharged first is a first print medium and the next print medium discharged onto the first one is a second print medium, the timing of discharging the second print medium can be controlled based on information on an area related to a portion of mediums where they are likely to contact each other (possible contact portion). The possible contact portion varies depending on the size of the print mediums and the lateral shift of the print mediums at the discharge position. To control the timing at which the second print medium is discharged, the print delay time for the second print medium may be selected appropriately.

Further, the first print medium may include an underlying print medium and an overlying print medium at the discharge position. The possible contact portion may include at least a part of the underlying print medium and at least a part of the overlying print medium.

Further, the print surface of the second print medium may be divided into a plurality of areas and information on ink ejected onto each of the divided areas may be acquired and used to replace information on the associated areas of the first print medium. In that case, the information on the area of the second print medium corresponding to the possible contact portion may be written over the information on the area of the first print medium corresponding to the possible contact portion. Then, when a third print medium is discharged over the second print medium already at the discharge position, the discharge timing of the third print medium can be controlled by taking the second print medium as the first print medium and the third print medium as the second print medium.

As an ink to form an image on a print medium, a pigment ink and a dye ink may be used. The information on areas described above may include only the information related to a pigment ink that does not easily dry.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-323803, filed Dec. 19, 2008, which is hereby incorporated by reference herein in its entirety.

What is claimed is:

1. An ink jet printing apparatus which prints on a print medium with a print head for ejecting ink by transporting the print medium in a transporting direction, the ink jet printing apparatus comprising:

a first acquiring unit that acquires information about an ink amount ejected on unit areas of a preceding print medium, with the preceding print medium divided into the unit areas in the transporting direction and a first crossing direction which crosses the transporting direction;

a second acquiring unit that acquires information about a size of a following print medium; and a setting unit that sets an interval between a printing of the preceding print medium and a printing of the following print medium based on information about an ink amount ejected on one or more unit areas, wherein the setting unit determines, among the divided unit areas, the one or more unit areas in a second crossing direction, which crosses a discharge direction in which the preceding print medium and following print medium are discharged, for setting the interval, based on the information about the size of the following print medium acquired by second acquiring unit.

2. The ink jet printing apparatus according to claim 1, wherein the information about the ink amount is information about the number of ink dots.

3. The ink jet printing apparatus according to claim 1, wherein the setting unit sets the interval such that a waiting time for transporting the following print medium in a transporting state is based on the information about the ink amount ejected on the unit areas among the divided unit areas based on the information about the size of the following print medium.

4. The ink jet printing apparatus according to claim 1, wherein the setting unit sets the interval based on information about a maximum ink amount ejected on a unit area included in unit areas among the divided unit areas based on the information about the size of the following print medium.

5. The ink jet printing apparatus according to claim 1, further comprising a third acquiring unit that acquires an elapsed time that has passed from when the unit areas have received an ink amount based on the information about the size of the following print medium, wherein the setting unit sets the interval based on the elapsed time.

6. The ink jet printing apparatus according to claim 1, wherein the divided unit areas are unit areas into which an area of the preceding print medium, on which the print head passes by one scan, is divided in the first crossing direction.

7. The ink jet printing apparatus according to claim 1, wherein the print head ejects a dye ink and a pigment ink, the first acquiring unit acquires information about an amount of pigment ink ejected on each of the unit areas.

8. An ink jet printing method for printing on a print medium with a print head for ejecting ink by transporting the print medium in a transporting direction, the ink jet printing method comprising steps of:

acquiring information about an ink amount ejected on unit areas of a preceding print medium, with the preceding print medium divided into the unit areas in the transporting direction and a first crossing direction which crosses the transporting direction;

acquiring information about a size of a following print medium; and setting an interval between a printing of the preceding print medium and a printing of the following print medium based on information about an ink amount ejected on one or more unit areas, wherein the one or more unit areas in a second crossing direction, which crosses a discharge direction in which the preceding print medium and following print medium are discharged, are determined among the divided unit areas for setting the interval, based on the information about the size of the following print medium.

9. The ink jet printing method according to claim 8, wherein the information about the ink amount is information about the number of ink dots.

10. The ink jet printing method according to claim 8, wherein the interval is set such that a waiting time set for transporting the following print medium in a transporting state is based on the information about the ink amount ejected on the unit areas among the divided unit areas based on the information about the size of the following print medium.

11. The ink jet printing method according to claim 8, wherein the interval is set based on information about a maximum ink amount ejected on a unit area included in unit areas among the divided unit areas based on the information about the size of the following print medium.

12. The ink jet printing method according to claim 8, further comprising steps of acquiring an elapsed time that has passed from when the unit areas have received an ink amount based on the information about the size of the following print medium, wherein the interval is set based on the elapsed time.

13. The ink jet printing method according to claim 8, wherein the divided unit areas are unit areas into which an area of the preceding print medium, on which the print head passes by one scan, is divided in the first crossing direction.

14. The ink jet printing method according to claim 8, wherein the print head ejects a dye ink and a pigment ink, information about an amount of pigment ink ejected on each of the unit areas is acquired.

* * * * *